US005313896A

United States Patent [19]

Hashiride

[11] Patent Number: 5,313,896

[45] Date of Patent: May 24, 1994

[54] SYSTEM FOR EMBROIDERING MACHINE

[75] Inventor: Tadaaki Hashiride, Okazaki, Japan

[73] Assignee: Aisin Seiki Kabushiki Kaisha, Kariya, Japan

[21] Appl. No.: 947,793

[22] Filed: Sep. 21, 1992

[30] Foreign Application Priority Data

Sep. 20, 1991 [JP] Japan ..... 3-241668

[51] Int. Cl.[5] ..... D05B 21/00

[52] U.S. Cl. ..... 112/121.12; 112/103; 112/155; 112/445

[58] Field of Search ..... 112/121.12, 103, 155, 112/121.11, 2, 262.3, 266.1, 445, 78, 86, 98; 364/470

[56] References Cited

U.S. PATENT DOCUMENTS

| | | | |
|---|---|---|---|
| 4,352,334 | 10/1982 | Childs et al. | 112/266.1 |
| 4,369,722 | 1/1983 | Nishida et al. | 112/103 |
| 4,635,574 | 1/1987 | Fujita et al. | 112/155 X |
| 4,742,786 | 5/1988 | Hashimoto et al. | 112/121.12 |
| 4,860,678 | 8/1989 | Skogward | 112/445 |
| 4,932,342 | 6/1990 | Hisatake et al. | 112/155 X |
| 4,936,232 | 6/1990 | Monma | 112/155 X |

FOREIGN PATENT DOCUMENTS

| | | |
|---|---|---|
| 56-123448 | 9/1981 | Japan . |
| 58-22090 | of 1983 | Japan . |

*Primary Examiner*—Peter Nerbun

*Attorney, Agent, or Firm*—Burns, Doane, Swecker & Mathis

[57] ABSTRACT

A system for an embroidering machine has plural embroidering machines, display means, input means which has a keyboard and a means for inputting coordinates on a screen of the display, register memory means for storing plural embroidering patterns, image data and embroidering data and main control means. The main control means divides a screen of the display means into multiple screens in accordance with a number input by the input means, reads image data corresponding to the embroidering patterns selected by the input means from the register memory means, displays the image data on the multiple divided screens of the display means, and sends embroidering data corresponding to the selected embroidering patterns to the memory means of the embroidering machine. The main control means divides the screen of the display into smaller screens display multiple embroidering images on the screens. Thus an operator can see all embroidering patterns on the screen of the display before embroidering.

6 Claims, 37 Drawing Sheets

Fig. 23 character file

| | 0 | 1 | 2 | 3 | 4 | 5 | | F |
|---|---|---|---|---|---|---|---|---|
| 2330 | 0 | 1 | 2 | 3 | 4 | 5 | | |
| 2340 | | A | B | C | D | E | | 0 |
| 2350 | P | Q | R | S | T | U | | |
| 2360 | | a | b | | | | | |

※ "2341" assigned to "A"

Fig. 24 filing to name register

| | name register | | | |
|---|---|---|---|---|
| order | NM1 | NM2 | .... | last (NMm) |
| character | A | I | .... | N |
| file name | F1=2341.100 | F2=2349.100 | .... | Fm=234E.100 |
| data | CH1 | CH2 | .... | CHm |

relative coordinates $S_n(x_n, y_n)$
$S_0(x_0, y_0) = (0, 0)$
$S_1(x_1, y_1) = (-5, -6)$
$\vdots$
$S_n(x_n, y_n) = (\Delta x, \Delta y)$ S: center $S_{Rn}(x_n, y_n)$
$S_{R0}(x_0, y_0)$
$S_{R1}(x_1, y_1)$
$\vdots$
$S_{Rn}(x_n, y_n)$ coordinates pick register

| order | | 1st | 2nd | last |
|---|---|---|---|---|
| coordinates | y | $y_1$ | $y_2$ | $y_3$ |
| | x | $x_1$ | $x_2$ | $x_3$ |
| P (x, y) | | P ($x_1$, $y_1$) | P ($x_2$, $y_2$) | P ($x_3$, $y_3$) |

Layout register

| divided points | divided coordinates | angle |
|---|---|---|
| $D_1$ | $R(x_1, y_1) = P(x_1, y_1)$ | |
| $D_2$ | $R(x_2, y_2)$ | $\theta_1$ |
| $D_3$ | $R(x_3, y_3) = P(x_2, y_2)$ | $\theta_2$ |
| $D_4$ | $R(x_4, y_4)$ | $\theta_3$ |
| $D_5$ | $R(x_5, y_5) = P(x_3, y_3)$ | $\theta_4$ |

1. pick up base color
2. if divided area>0.5 put one color
3. if piled up change color
4. piled up n times, put n color

SYSTEM FOR EMBROIDERING MACHINE

BACKGROUND OF THE INVENTION

1. Field of the Invention

The present invention relates to a system for an embroidering machine, and especially to a system for an embroidering machine which has a computer to control embroidering data. The computer controls multiple machines independently so that each embroidering machine stitches different patterns at the same time.

2. Description of the Prior Art

A conventional embroidering machine is shown in U.S. Pat. No. 4,369,722 and Japanese Laid-Open Patent Sho 56-123448 (1982). Japanese Laid-Open Patent Sho 58-22090 (1983) corresponds to U.S. Patent application Ser. No. 289,825 filed on Aug. 3, 1992 shows a system for embroidering letters along a curve. U.S. Pat. No. 4,369,722 shows a system for an embroidering machine. An operator inputs a code assigned to each embroidering pattern and machine number into a pattern set board. A magnetic tape contains embroidering data is set on a magnetic tape reader to install embroidering data onto a computer memory. The pattern set board indicates a machine number and it's input code. The computer reads out the embroidering pattern from the memory in accordance with the code. The pattern set board does not indicate the embroidering pattern assigned to each machine.

It is important for an operator that a system shows a embroidering pattern on CRT display or liquid crystal display when an operator composites, combines or modifies an embroidering pattern on the computer or when keeps such embroidering pattern onto a hard disk, floppy disk or memory. Further it is better to show a embroidering pattern on the display while embroidering machines stitch the patterns. When the computer controls several embroidering machine at one time, all of the patterns currently embroidering must be shown on the display.

On the other hand, the system for embroidering machine is required to embroider many letter characters which vary from the various languages. It is important for a embroidering machine to have a capability of selecting and arranging letter characters.

Further it is preferable that a system for embroidering machine can show thread patterns of the characters before the machine actually embroiders when threads or settings are changed.

SUMMARY OF THE INVENTION

Accordingly, one of the objects of the present invention is to produce a system for embroidering machine to obviate the above mentioned drawbacks.

Another object of the present invention is to produce a system for embroidering machine which can show all the patterns the machines embroidering on a display during the embroidering operation of the machines.

Further object of the present invention is to produce a system for embroidering machine which can embroider many letter characters. Especially a system for embroidering machine can select characters even they are pronounced same.

Yet another object of the present invention is to produce a system for embroidering machine which can show thread patterns on a display.

To achieve the above objects, and in accordance with the principles of the invention as embodied and broadly described herein, a system for embroidering machine comprises a plural of embroidering machine. Each embroidering machine has an embroidery frame, a frame motor for moving the frame in X and Y directions, a needle motor for a needle, memory means for storing embroidering data and control means for controlling the frame motor and needle motor in accordance with the embroidering data. A system for embroidering machine comprises display means, input means which has a keyboard and a means for inputting coordinates on a screen of the display and register memory means for storing a plural of embroidering pattern, image data and embroidering data. A system for embroidering machine further comprises main control means for;

(a) dividing a screen of the display means into multiple screens in accordance with a number input by the input means, (b) reading image data corresponding to said embroidering patterns selected by said input means from the register memory means, (c) displaying the image data on the multiple divided screens of the display means, and (d) sending embroidering data corresponding to the selected embroidering patterns to the memory means of the embroidering machine.

In accordance with the invention, when four embroidering machines embroider the different patterns at the same time and an operator inputs the number four by using the input means, the main control means divides the screen of the display into four smaller screens. When an operator selects embroidering patterns to each embroidering machine, the main control means reads the image data corresponding to each embroidering pattern from the register memory to display the images on the screens. Thus an operator can see all embroidering patterns on the screen of the display before embroidering.

Further the main control means of a system for embroidering machine of this invention displays a piled area of the threads of the selected embroidering pattern on the display means so that the thread density can be checked.

In accordance with the invention, a pile area of the embroidering pattern can be indicated in different colors from the other.

BRIEF DESCRIPTION OF THE DRAWING

For a full understanding of the true scope of the invention, the following detailed description should be read in conjunction with the drawing, wherein

FIG. 23 is an image of the codes correspond to alphabetical letters shown on the display 4.

FIG. 24 is a chart which shows data of the name register which registers file names assigned to a combined pattern.

DETAILED DESCRIPTION OF THE PREFERRED EMBODIMENTS.

Figure 1:
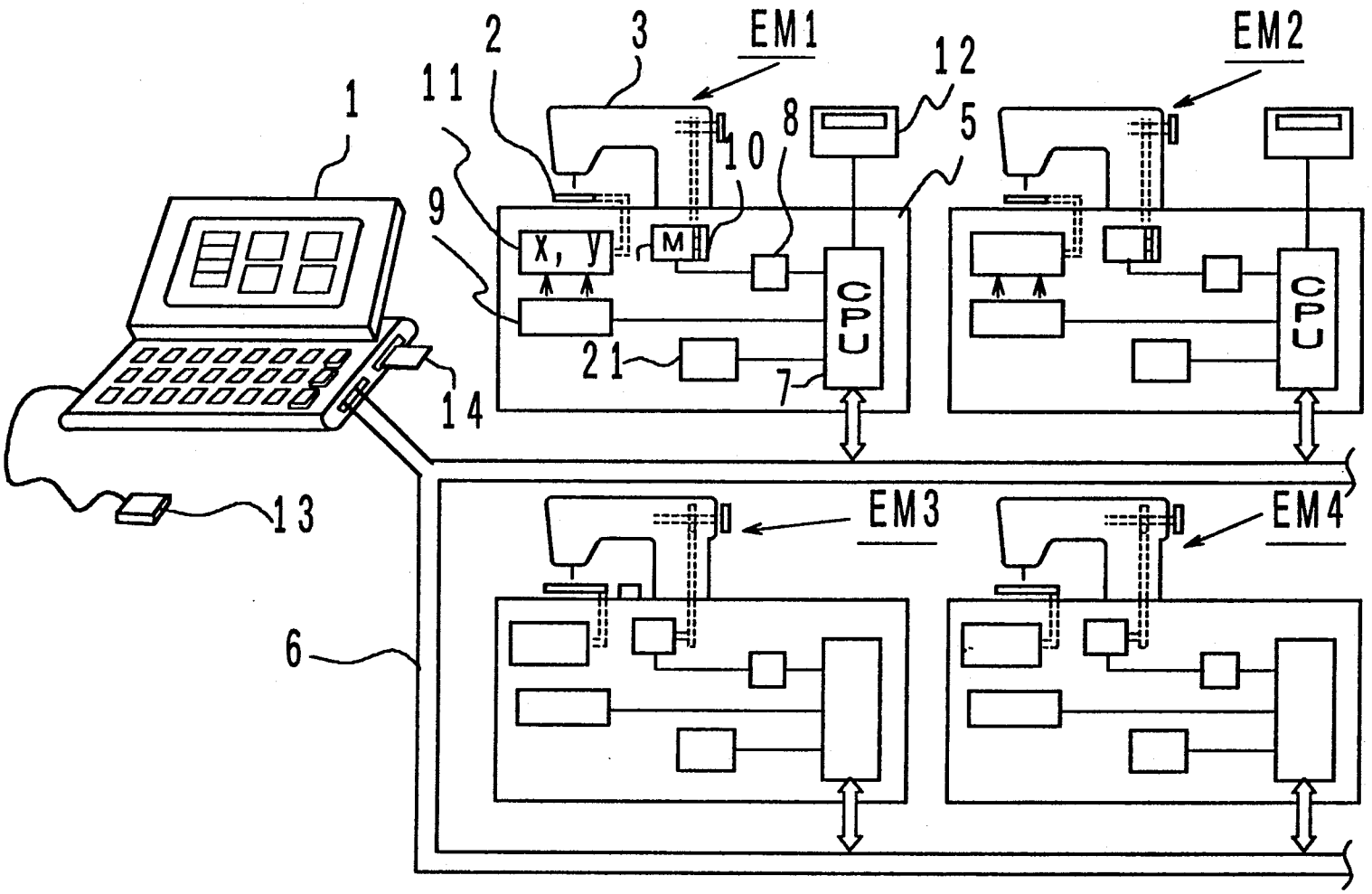
FIG. 1 is a block diagram which shows a system for embroidering machine of the present invention.
Figure 2:
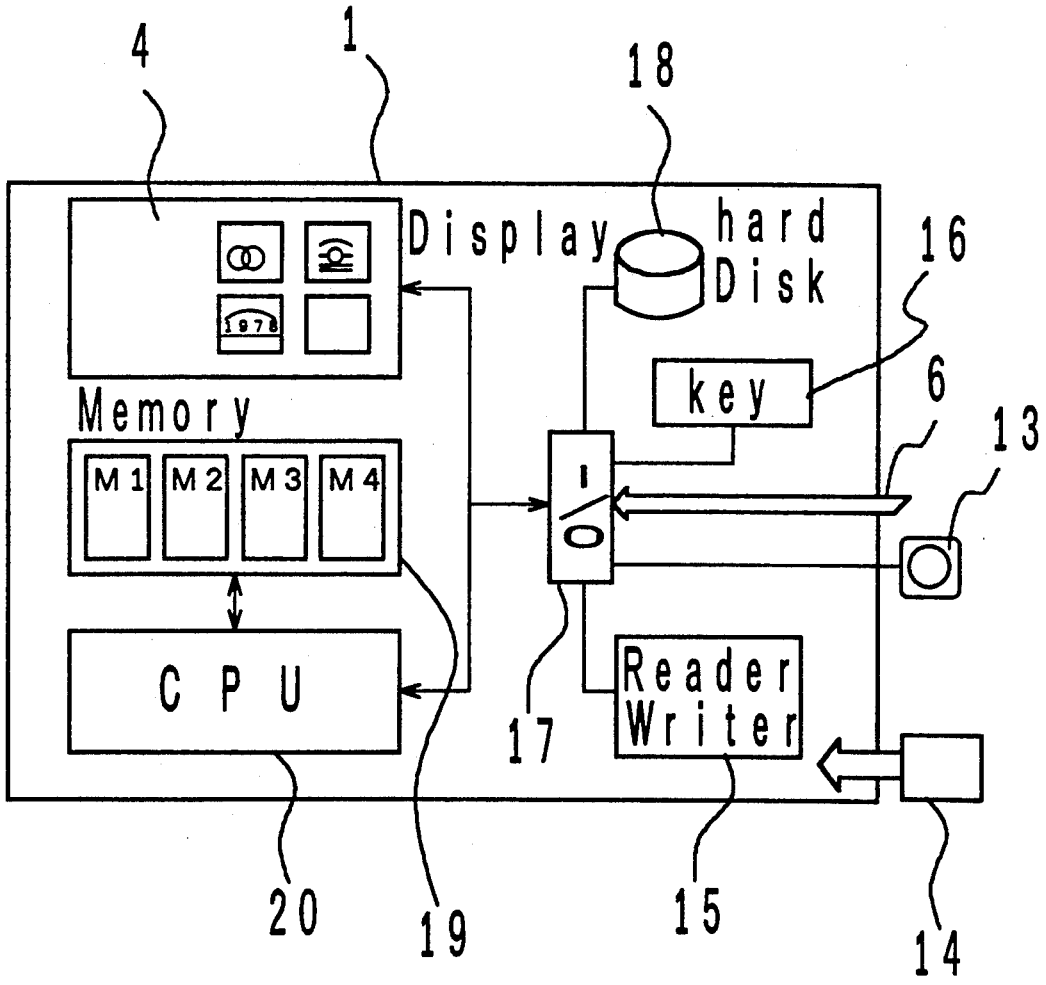
FIG. 2 is a block diagram which shows a controller of the system shown in FIG. 1 of the present invention.

In the following, preferred embodiments of the present invention will be described with reference to the drawings. FIG. 1 shows one embodiment of the present invention. The controller 1 is connected with each embroidering machines EM 1–4 through the data line 6. Referring to FIGS. 1 and 2, a micro processor 7 (herein after refer to machine computer 7) of the embroidering machine EM 1 has a control board 12 with a ten key, control keys and a display. When an operator sends signals using the ten key and control keys to the controller I to select an embroidering pattern displayed on the display 4, the machine computer 7 requests a micro processor 20 (herein after refer to the main computer 20) of the controller 1 of the embroidering data corresponding to the selected embroidering pattern. The main computer 20 sends the embroidering data to the buffer memory 21 of the embroidering machine EM 1. When an operator operates the key board 16 or the mouse 13 of the controller 1 to transfer the embroidering pattern corresponds to the embroidering machine EM 1 to the embroidering data, the main computer 20 sends the embroidering data to the buffer 21 of the embroidering machine EM 1. When the operator operates the start key of the control board 12, the machine computer 7 reads the embroidering data from the buffer memory 21 and controls the X and Y motor driver 9 and the machine driver 8. The embroidering machine EM 1 moves the embroidering frame 2 in X and Y directions by the X and Y motor driver 9 in accordance with the machine computer 7. The machine driver 8 controls the machine motor 10 and the needle mechanism 3 to embroider the patterns.

Other embroidering machines EM 2–4 has the same or similar system and functions as the embroidering machine EM 1. In FIG. 1, the controller 1 is connected to four embroidering machines EM 1–4, but the number of the embroidering machine can be up to eight.

Referring FIG. 2, the controller 1 has the main computer 20, ten key, the key board 16 including alphabetical keys and control keys, a color liquid crystal display 4, a mouse 13 to control the cursor on the screen of the display 4, four image RAM memories 19, a disk drive 15, a hard disk 18 and I/O interface 17. A floppy disk 14 is inserted into the slot of the disk drive 15. The main computer 20 stores the initial program which operates when the power becomes on. An embroidering program mentioned later is stored in a disk so that an operator can copy it onto the hard disk 18 in the controller 1. The image data of the various languages are also provided in disks. Premade embroidering patterns and its image data may be provided. In this system the disk drive 15 and the hard disk 18 operate equal in terms of the media of memory although the process speeds are quite different. The hard disk 18 can access to the buffer memory to save data temporary in the buffer memory.

Four RAM memories 19 of the controller 1 as a whole consist the image memory to store image data for the color display 4. Each RAM memory 19 stores one quarter of the screen image. An operator can instruct the number of the divided screen either one (no divided screen, one embroidering pattern), four (four divided screen, four embroidering patterns) or eight (eight embroidering patterns) by using the keyboard 16 or the mouse 13. When the one screen is selected, the image data of the one embroidering pattern is stored in four RAM memories. When the four divided screen is selected, each RAM memory stores one of four image data corresponding the four embroidering patterns, correspondingly. When the eight divided screen is selected, each RAM memory stores two image data corresponding to the two embroidering patterns. The stored image data is used for displaying the patterns on the display 4.

FIGS. 3 to 15 show the main operations of the main computer 20 and FIGS. 16 to 22 show the screen images on the display 4.

Figure 3:
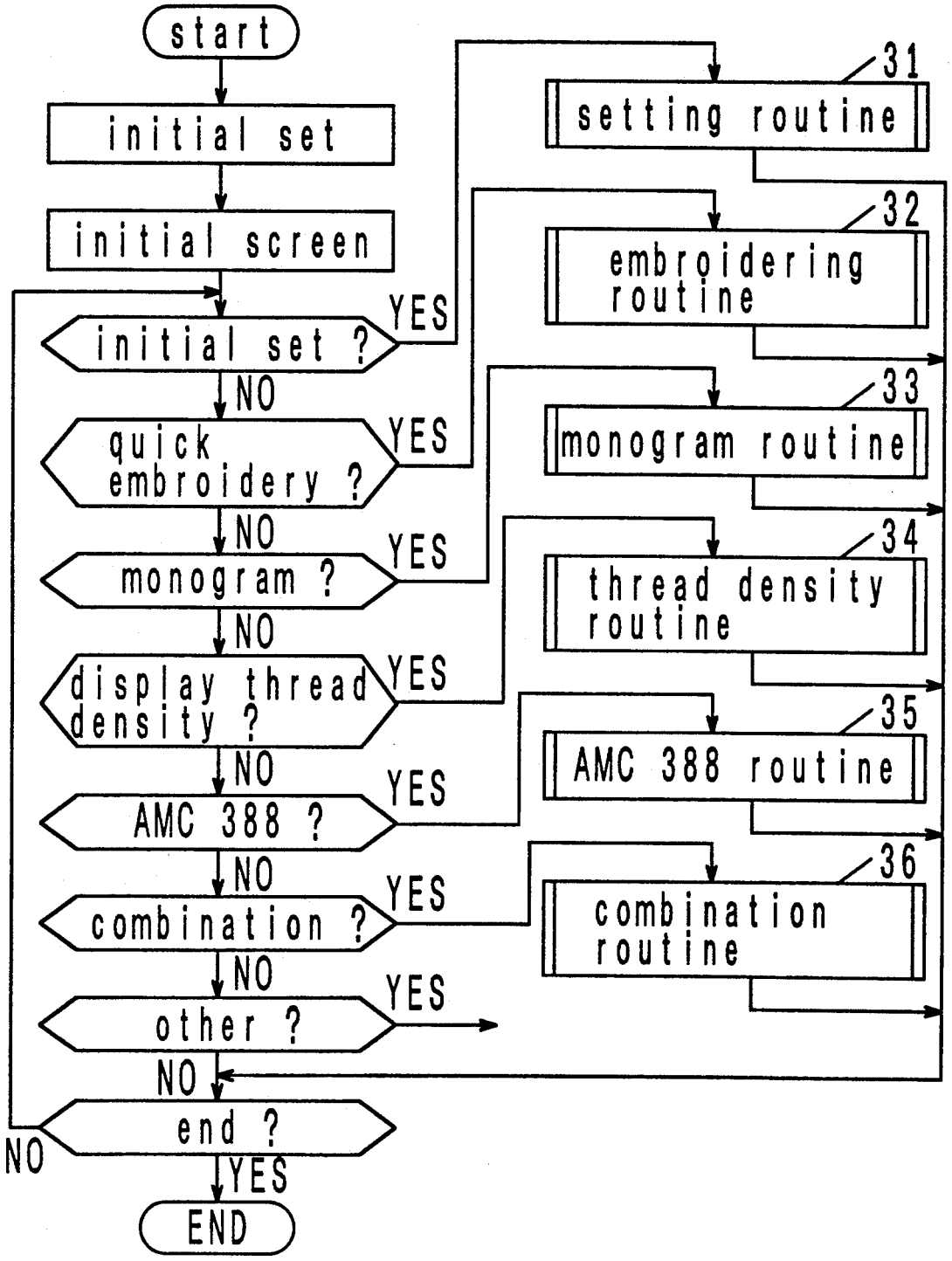
FIG. 3 is a flow chart which shows an operation of the main computer 20 shown in FIG. 2.
Figure 16:
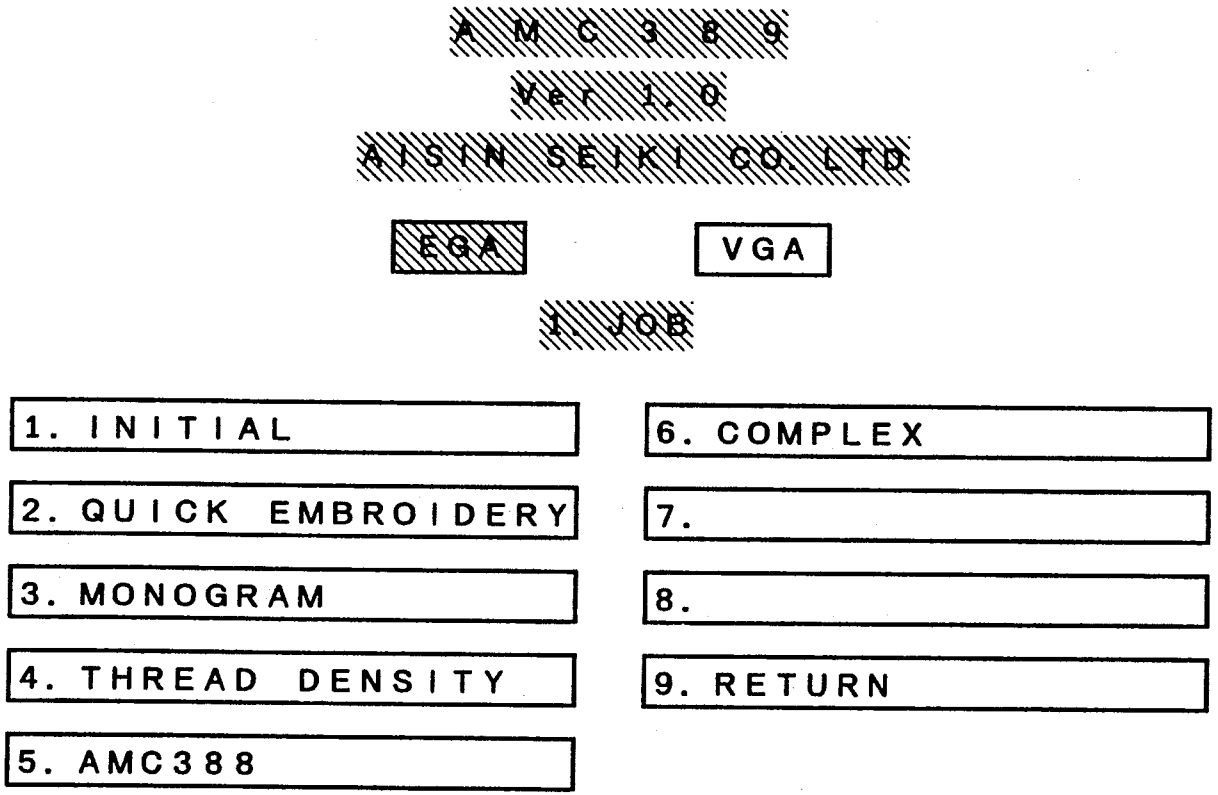
FIG. 16 is an image on the display 4 shown in FIG. 2 when the controller 1 operates in accordance with "initial display" shown in FIG. 3.
Figure 17:
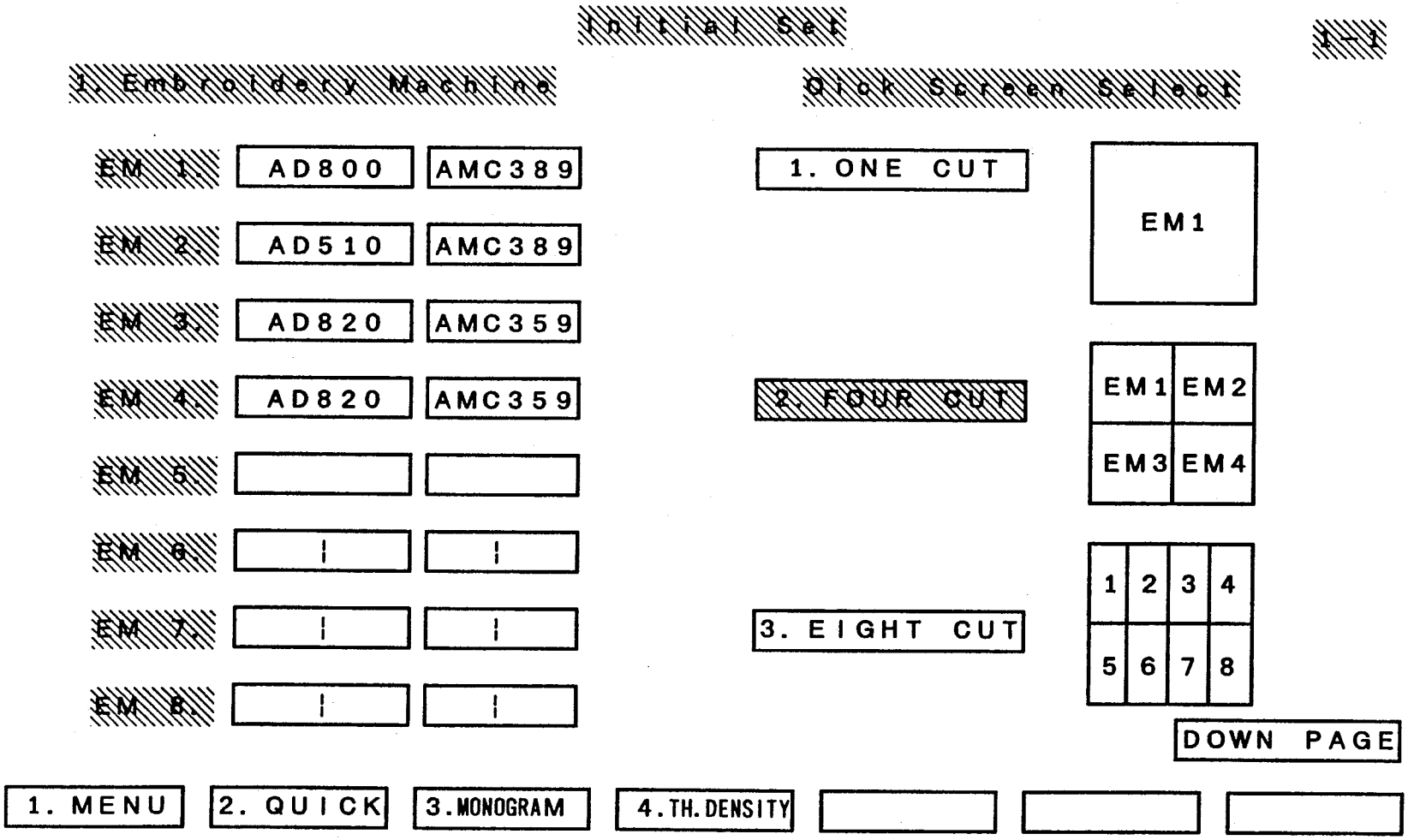
FIG. 17 is an image on the display 4 in accordance with the signals sent by the controller 1.
Figure 18:
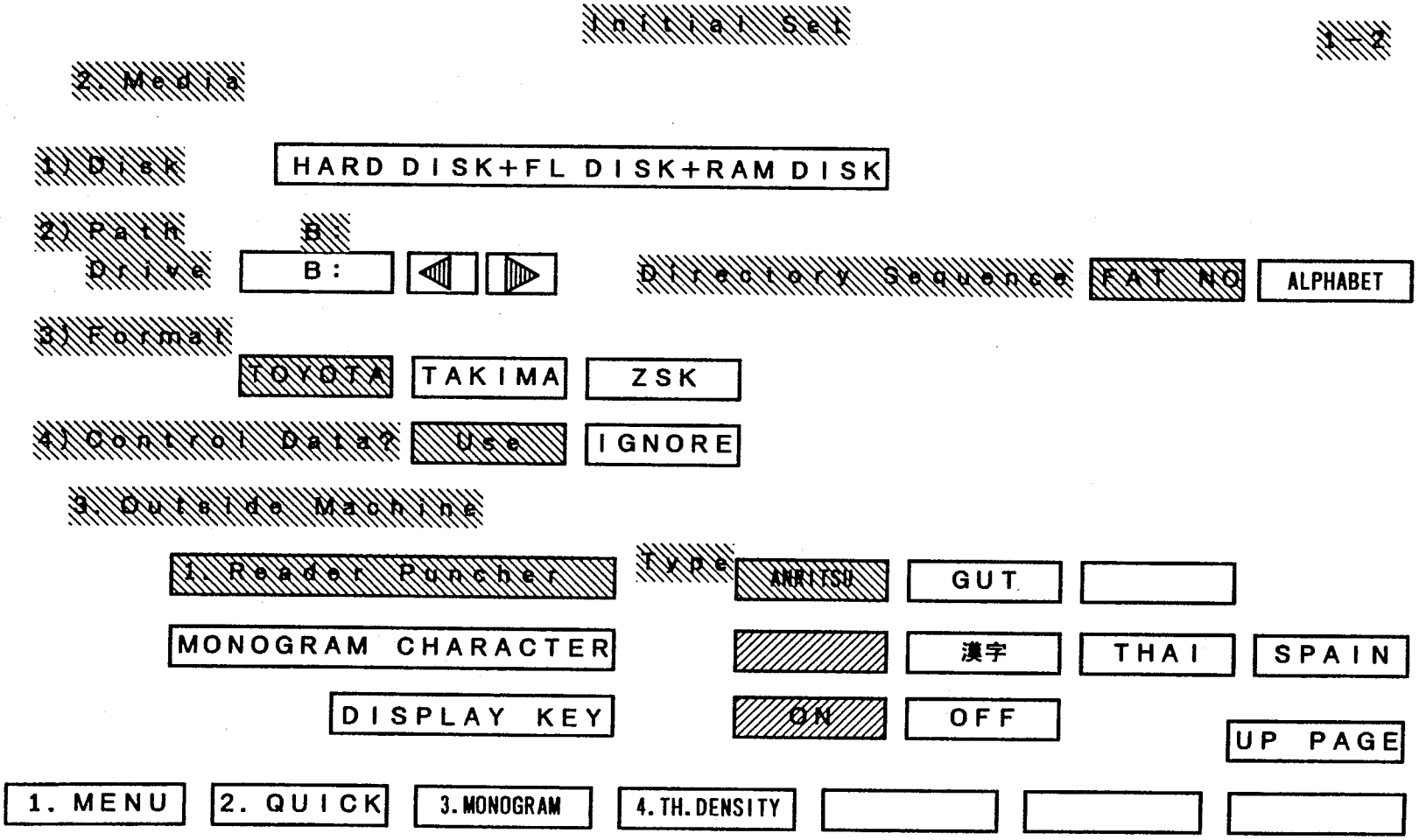
FIG. 18 is an image on the display 4 in accordance with the signals sent by the controller 1.

When the power is on, the main computer 20 executes the initial program stored in the main computer 20. The main computer 20 reads out the embroidering program as shown in FIG. 3 from the hard disk. The main computer 20 displays the initial menu as shown in FIG. 16 on the display 4 in accordance with the initial screen set in the program shown in FIG. 3. When the keyboard 16 or the mouse 13 indicates "1.INITIAL" is operated from the initial menu, the main computer 20 executes the "set routine" 31 of the program. The set routine 31 sends the screen image as shown in FIG. 17 to the display 4. This screen shows "1. ONE CUT", "2. FOUR CUT" and "3. EIGHT CUT". In this FIG. 17, "2. FOUR CUT" is selected and the machine data of the four embroidering machines EM 1–4 are displayed. When the "DOWN PAGE" is operated, the main computer 20 displays the image as shown in FIG. 18 on the display 4. The screen shown in FIG. 18 is for an operator to select a recording medium from the hard disk 18 or the floppy disk drive 14, to select data format, to select types of the embroidering machine and to select a language of the embroidering pattern. When the "1. MENU" is selected from the screen shown in either FIGS. 17 or 18, the main computer 20 displays the initial menu screen shown in FIG. 16 on the display 4. The parameters set according to the screens shown in FIGS. 17 and 18 are changeable during the operation.

Figure 4:
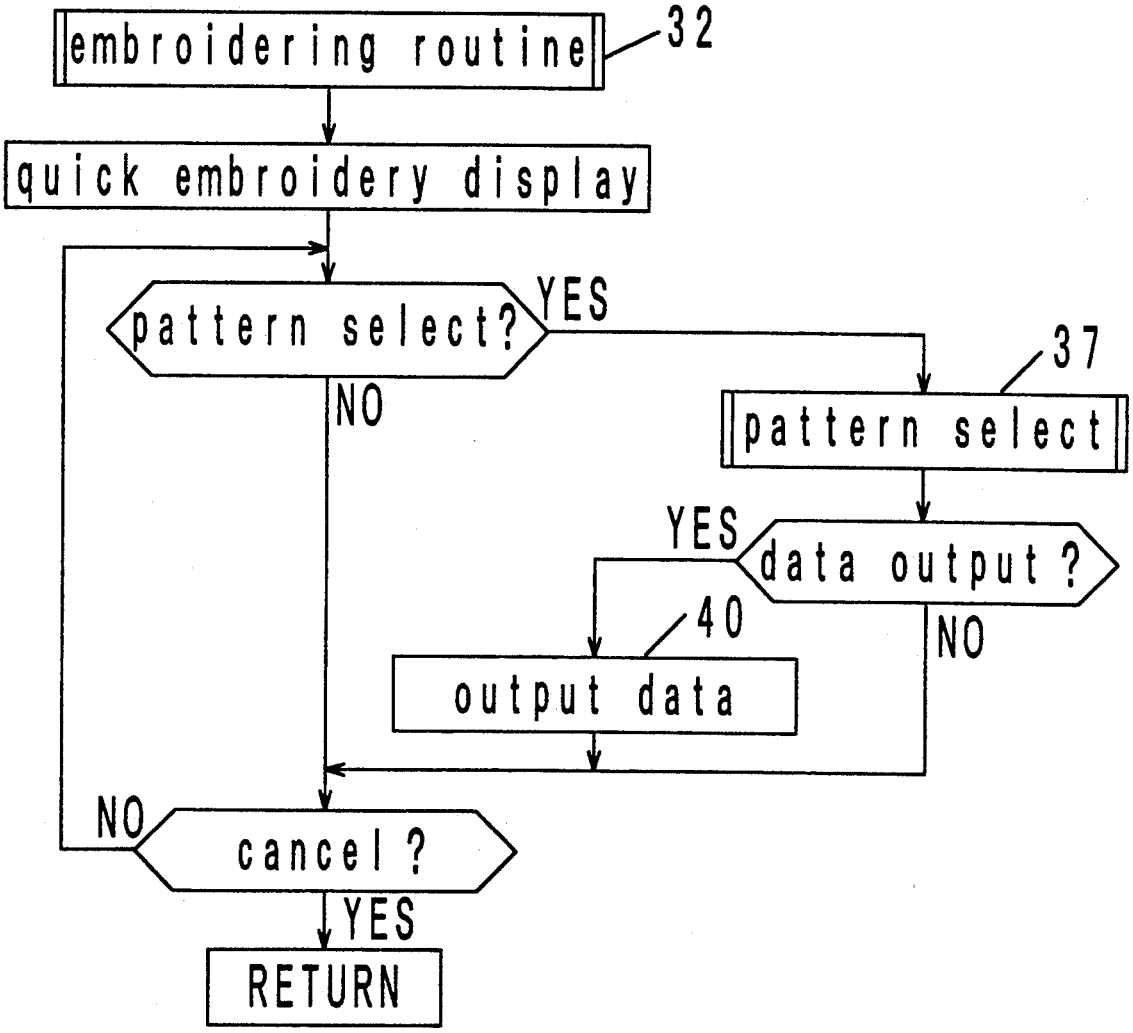
FIG. 4 is a flow chart which shows an operation of the "embroidering routine" 32 shown in FIG. 3.
Figure 5:
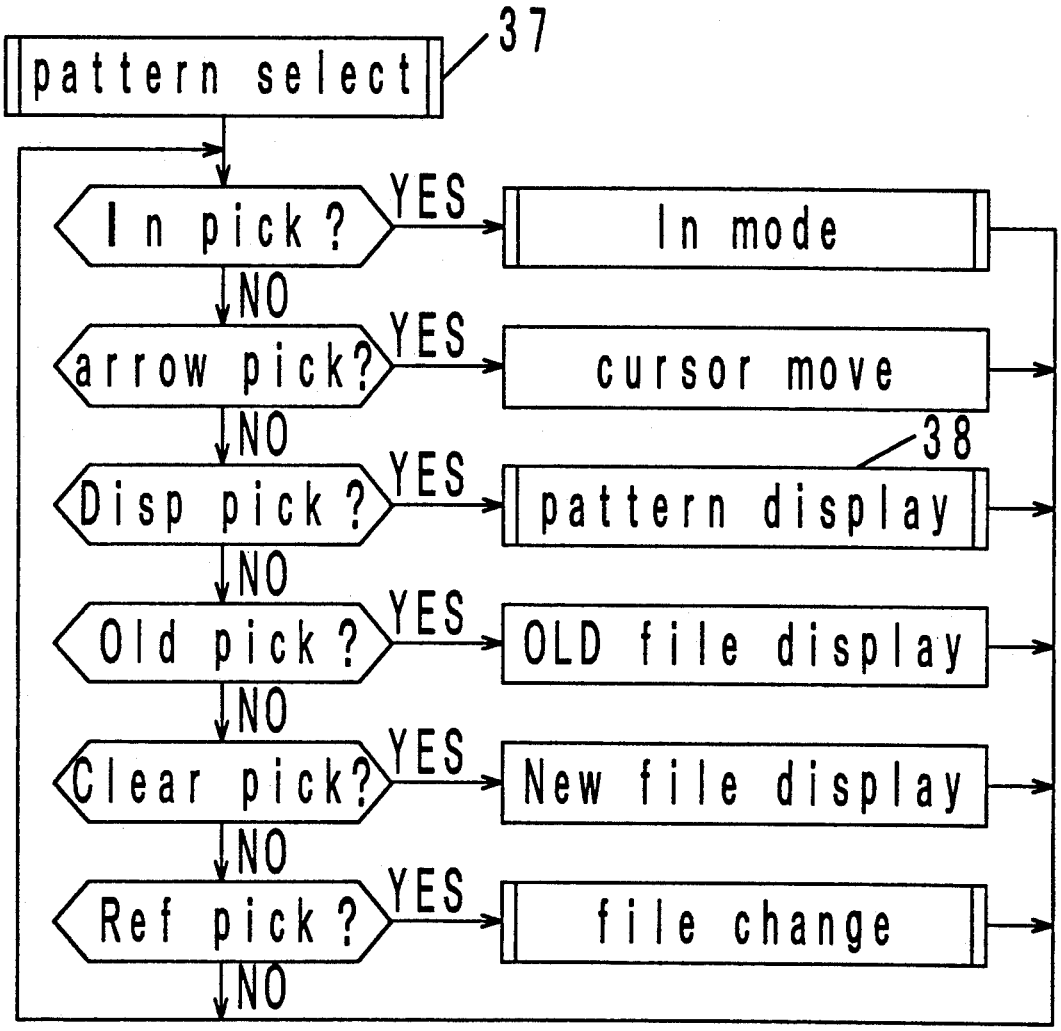
FIG. 5 is a flow chart which shows an operation of "selecting patterns" 37 shown in FIG. 4.
Figure 6:
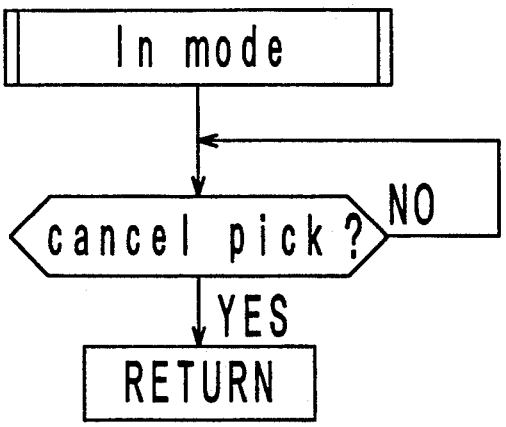
FIG. 6 is a flow chart which shows an operation of "In Model" shown in FIG. 5.
Figure 7:
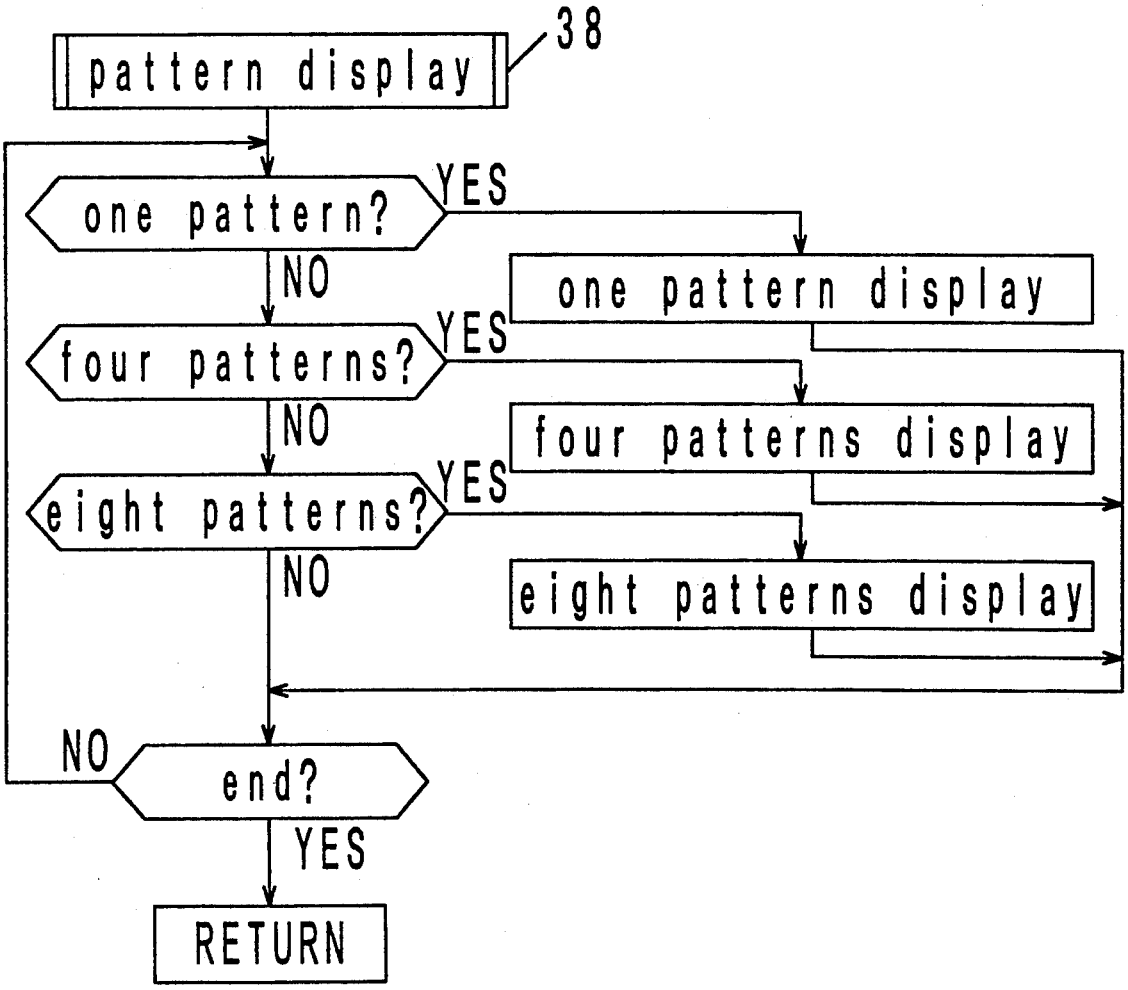
FIG. 7 is a flow chart which shows an operation of "display" 38 shown in FIG. 5.
Figure 8:
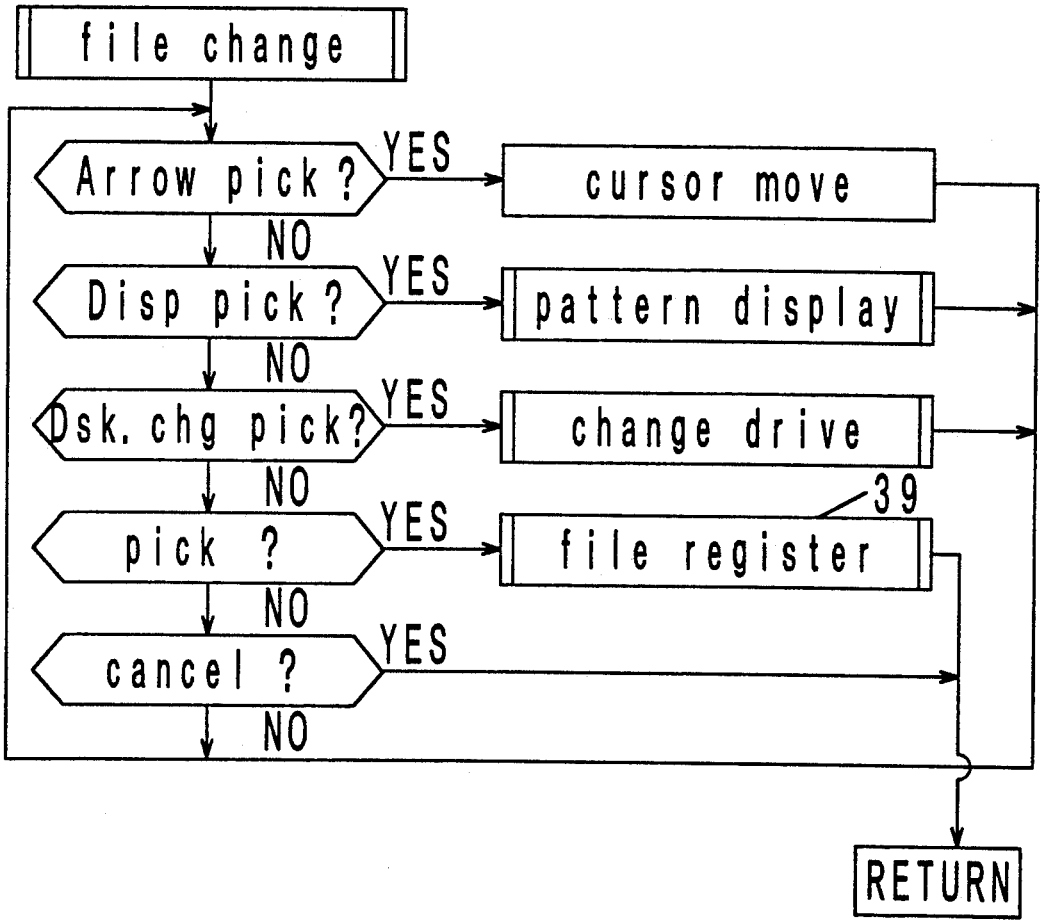
FIG. 8 is a flow chart which shows an operation of "file change" shown in FIG. 5.
Figure 9:
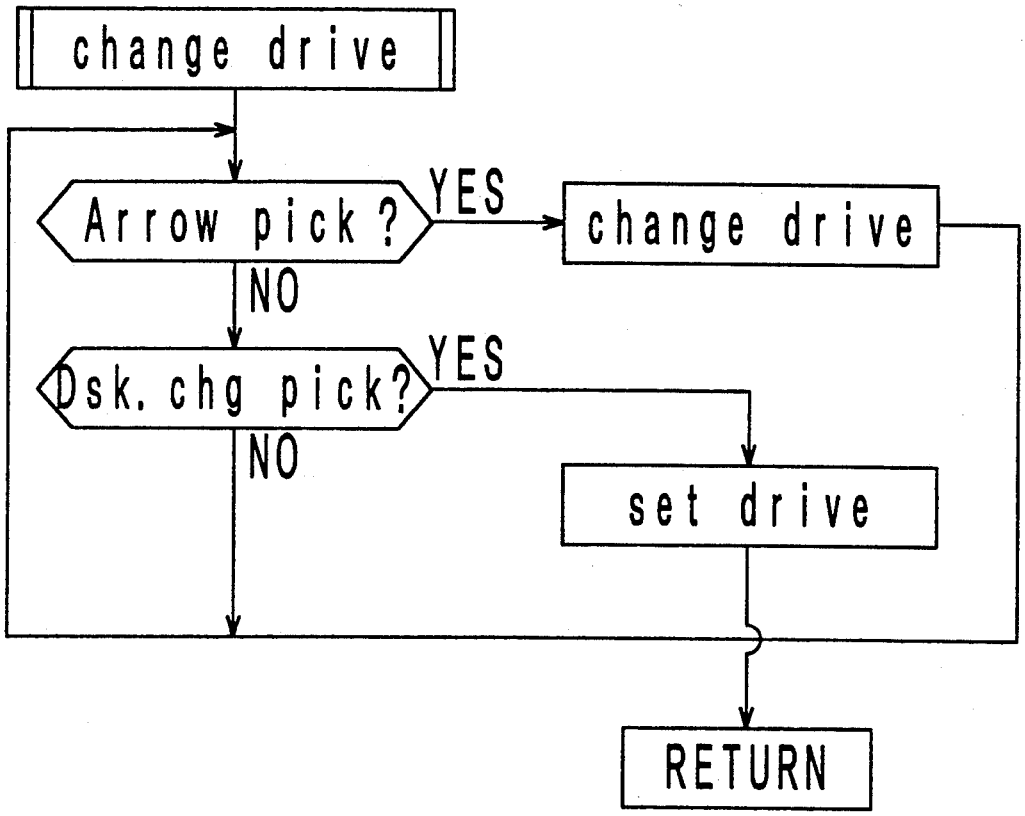
FIG. 9 is a flow chart which shows an operation of "drive change" shown in FIG. 8.
Figure 10:
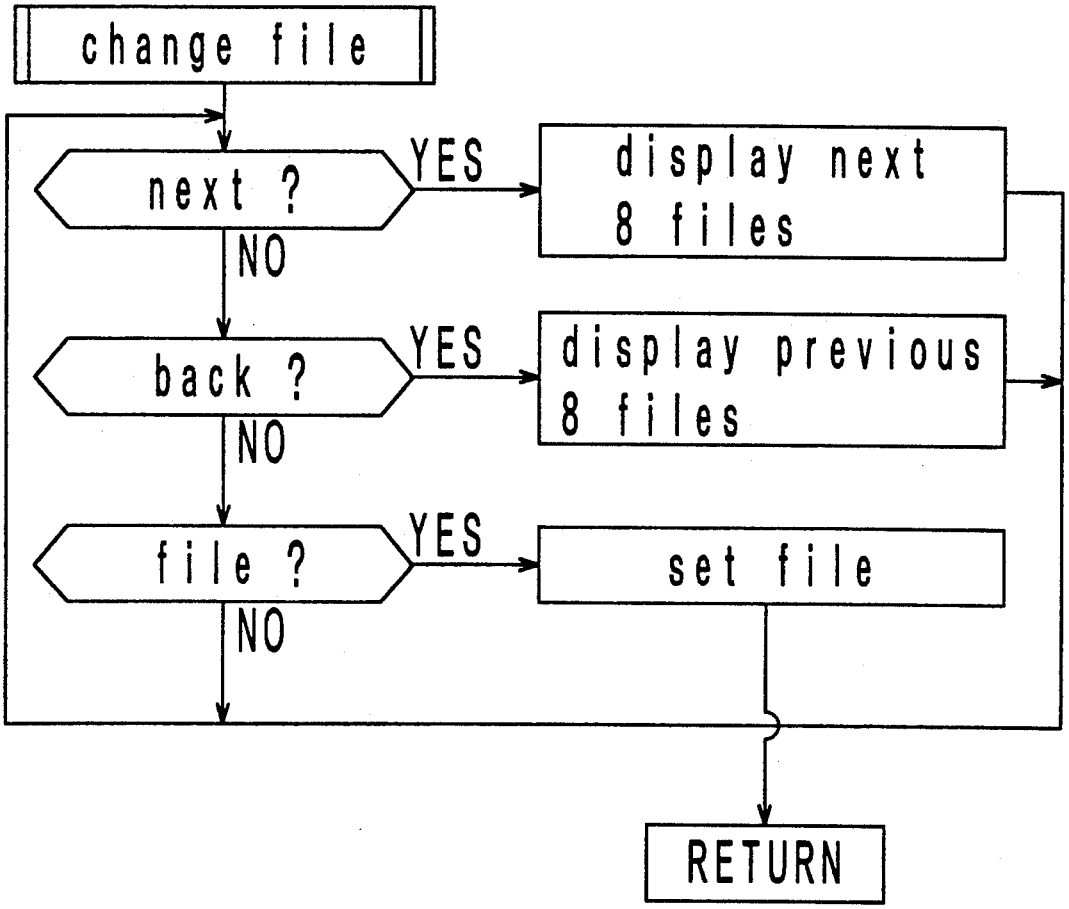
FIG. 10 is a flow chart which shows an operation of "file register" shown in FIG. 8.

When an operator selects the "2. QUICK EMBROIDERY", the main computer 20 executes the embroidering routine, 32 as shown in FIG. 4. First the quick embroidery screen is displayed on the display 4. When the "select pattern" is selected, the main computer 20 executes the select pattern routine 37 and displays the pattern select menu on the screen. FIGS. 5 to 8 show the operations of the pattern select routine. The main computer 20 reads the data selected by an operator such as the file name to save the pattern and the pattern image and data designated by such file name and writes the data into the hard disk 18 when the "FL Disk" is selected in the setting routine 31. When an operator selects the "DISP" from the screen shown in FIG. 19, the main computer 20 executes the pattern display 38 in FIG. 7 to display the pattern on the display 4. When the "control data ?" is selected with "IGNORE" in the setting routine 31, the main computer 20 ignores the data and does not write the data into the hard disk 18. When the "Disk" is selected with the "HARD DISK" in the setting routine 31, the main computer 20 reads the embroidering pattern data from the hard disk 18 in the setting routine 31. The main computer 20 executes the pattern display 38 in FIG. 7 when an operator selects the "DISP".

Figure 19:
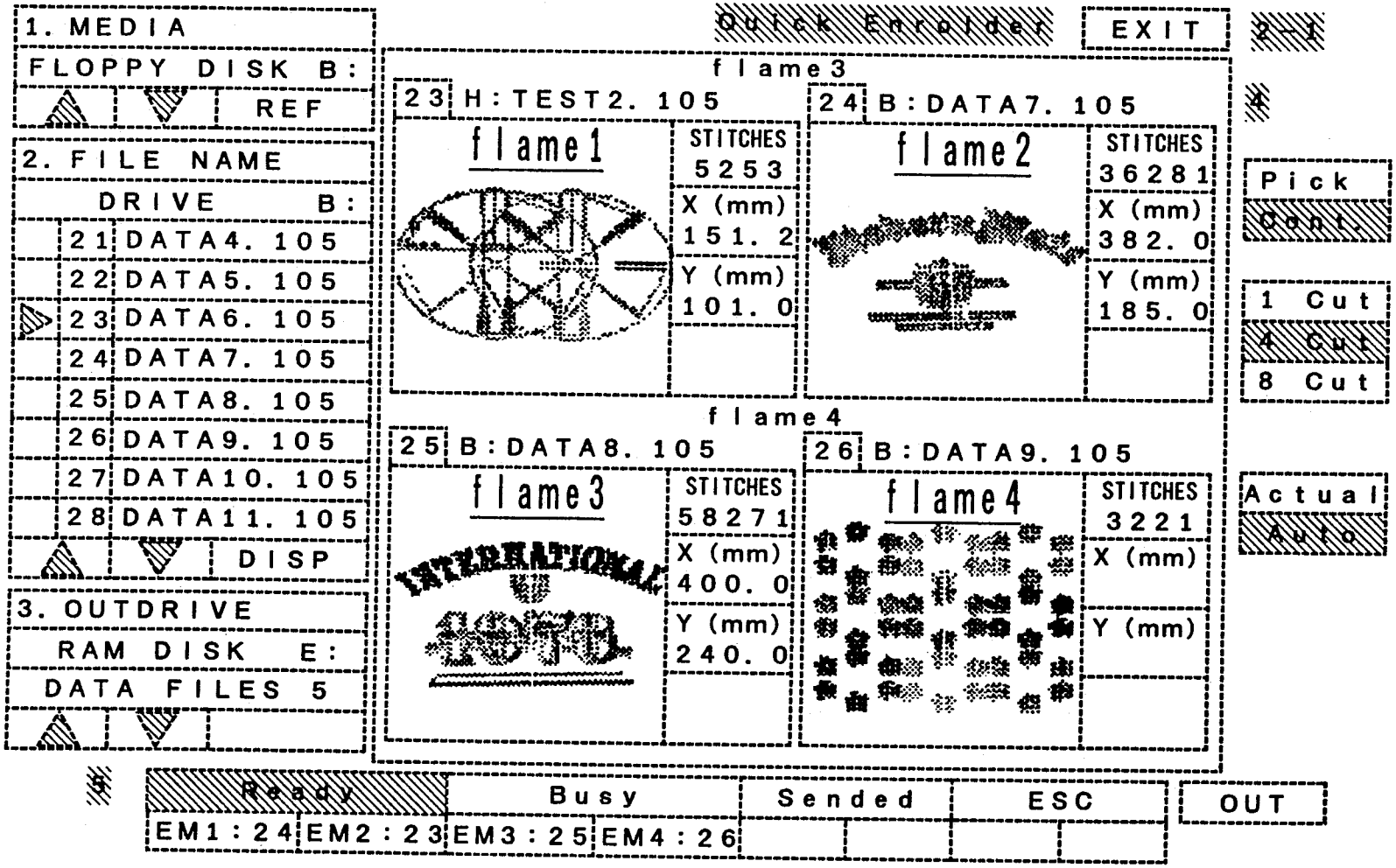
FIG. 19 is an image on the display 4 in accordance with the signals sent by the controller 1.

FIG. 19 shows the screen of the display 4 when the four divided screen is selected and the pattern selection 37 and the pattern display 38 are executed. Two triangles shown in the "1. MEDIA" of the display screen indicate that an operator can select the recording media from either the hard disk 18 or the floppy disk 14. When an operator selects one of the triangles, the recording media display changes from the hard disk to the floppy disk or the contrary. FIG. 19 shows that the eight file names are selected in the "2. File Name".

An operator selects the EM 1 at the bottom of the screen shown in FIG. 19 and operates the cursor top or down to select 24 so that the file name display at the bottom of FIG. 19 shows the file name 24 to be selected. In the same manner, an operator selects the file names 23, 25 and 26 for EM 2, 3 and 4, selectively. The embroidering data corresponding to the file names are sent to the embroidering machine EM 1–4 to store the data into the buffer memories 21. An operator can select a file name by using the operation board equipped to the each embroidering machine. When an operator inputs the file name 24 from the operation board 12 of the embroidering machine EM 1 and operates the key to request the data, the machine computer 7 requests the data selected by the file name 24 to the controller 1. The main computer 20 responds to the request and read the embroidering data corresponding to the file name 24 form the hard disk 18.

When an operator inputs the start signal from the operation board 12 of the embroidering machine EM 1, the machine computer 7 of the embroidering machine EM I controls the X, Y motor driver 9 in accordance with the data in the buffer memory 21. The machine computer 7 also controls the machine driver 8 in synchronized with the X, Y driver 9. The embroidering is made onto the cloth in the frame 2. The other embroidering machines EM 2, 3, 4 operate in the same manner with the embroidering machine EM 1. When the embroidering machine finishes the embroidering, the machine waits for next instructions.

Figure 20:
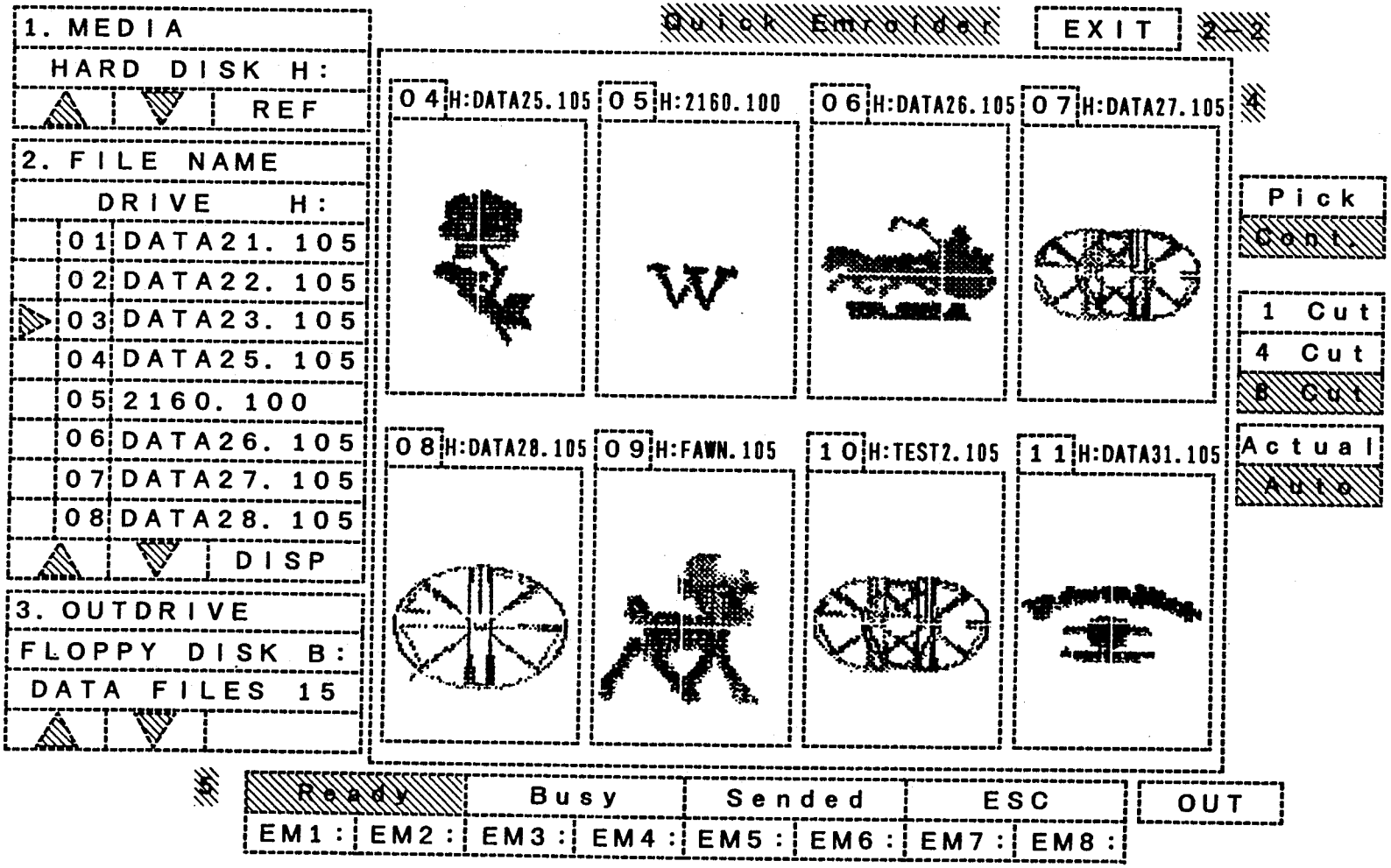
FIG. 20 is an image on the display 4 in accordance with the signals sent by the controller 1.

FIG. 20 shows the screen display for eight divided screen mode when the pattern display 38 is executed. The number of the divided screen can be changed by selecting either "1 Cut", "4 Cut" or "8 Cut" from the screen. When an operator selects "OUT" from the screen, the main computer 20 changes the screen display to the initial display shown in FIG. 16.

Figure 31:
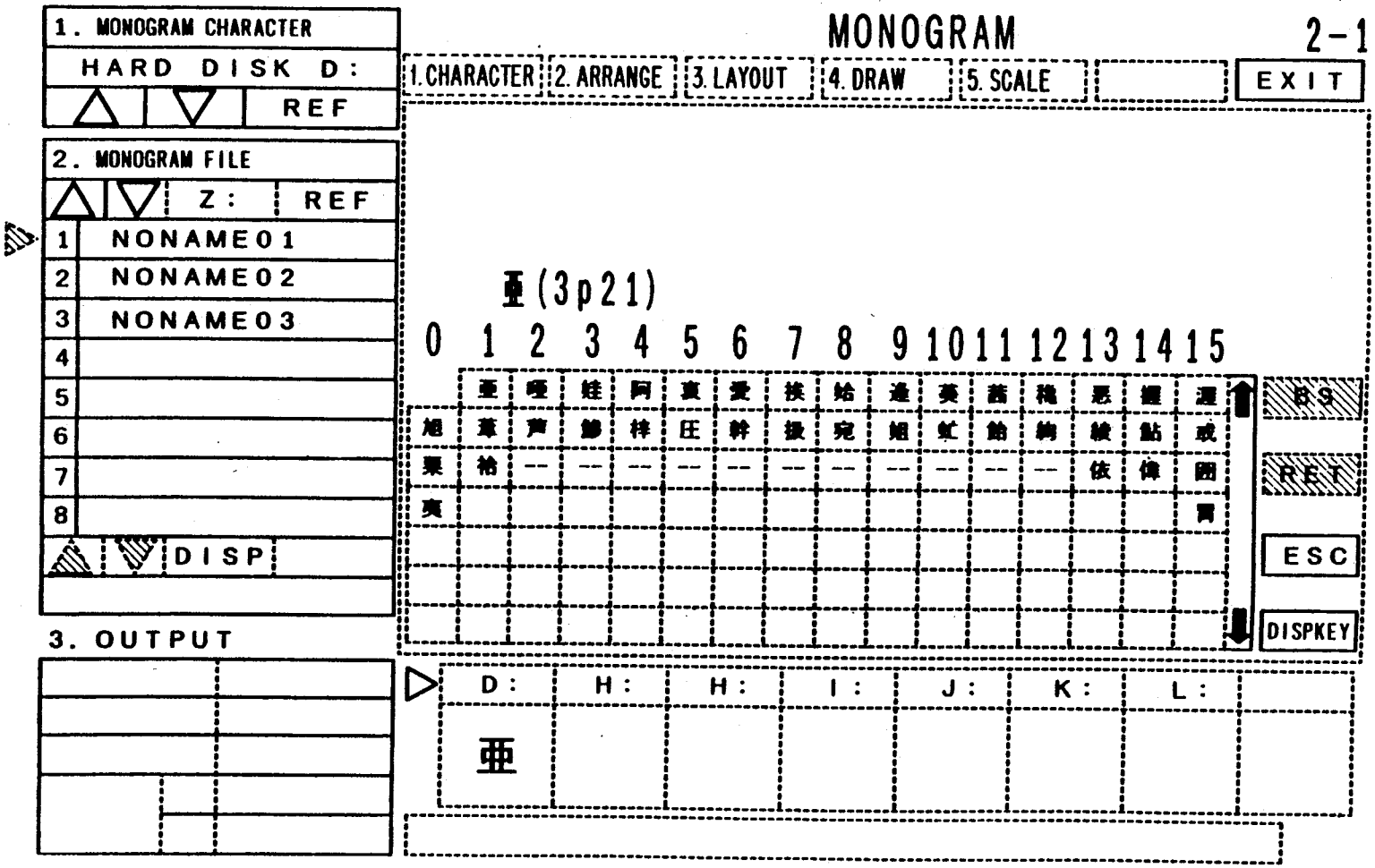
FIG. 31 is an image on the display 4 in accordance with the signals sent by the controller 1 shown in FIG. 2.

When an operator selects "3. MONOGRAM" from the initial display shown in FIG. 16, the main computer 20 executes the monograin routine 33 shown in FIG. 11. The main computer 20 displays the screen shown in FIG. 21. In this embodiment, the alphabetical keyboard is displayed. When the "MONOGRAM CHARACTER" is set to "Japanese Kanji", the main computer 20 displays the Japanese Kanji display on the screen. When the "CHARACTER" shown in FIG. 31 is operated, the main computer 20 changes the screen to the keyboard selecting screen. If "USA" id selected from this screen, the main computer 20 displays the screen shown in FIG. 21.

Figure 21:
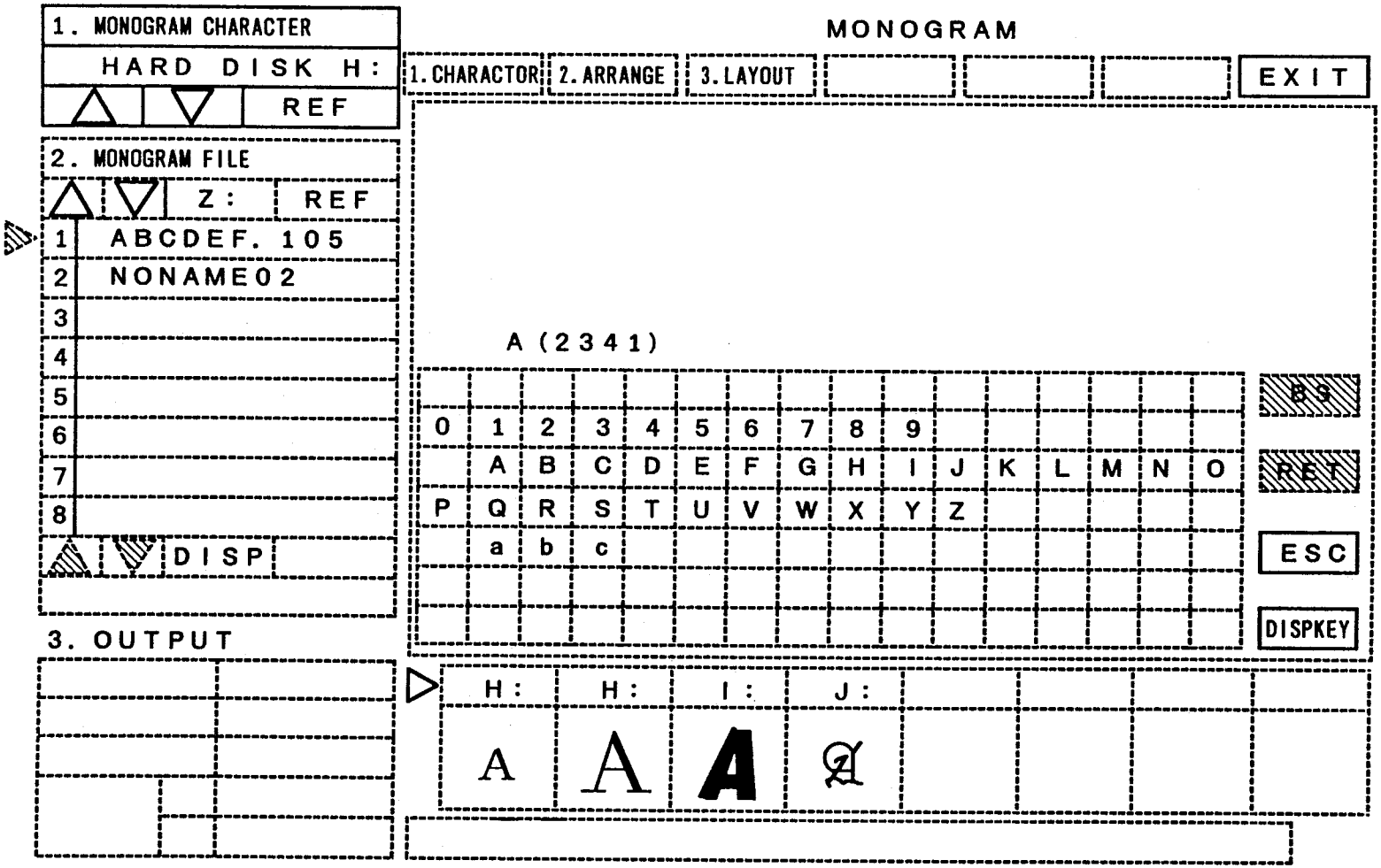
FIG. 21 is an image on the display 4 in accordance with the signals sent by the controller 1.
Figure 22:
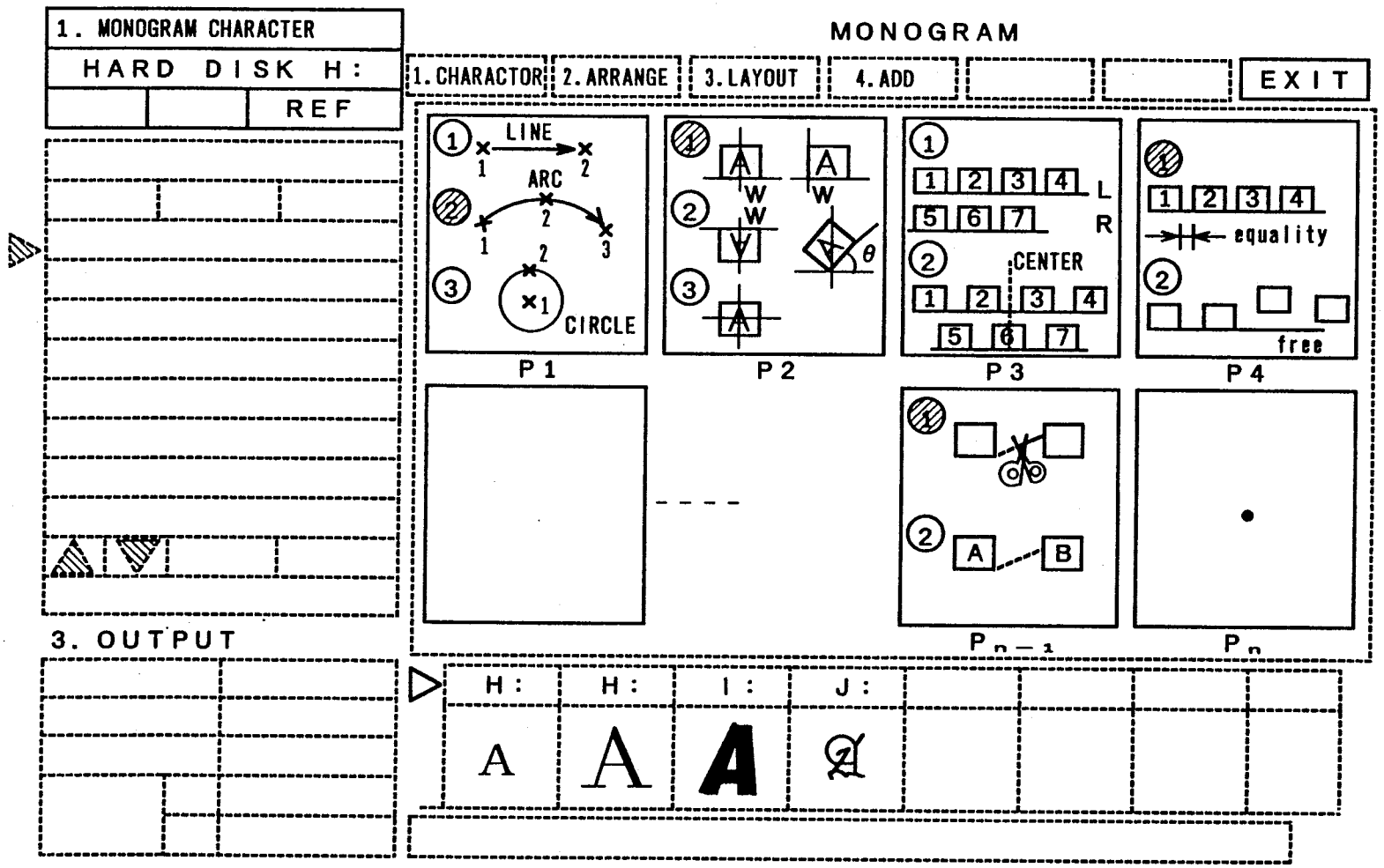
FIG. 22 is an image on the display 4 in accordance with the signals sent by the controller 1.
Figure 25:
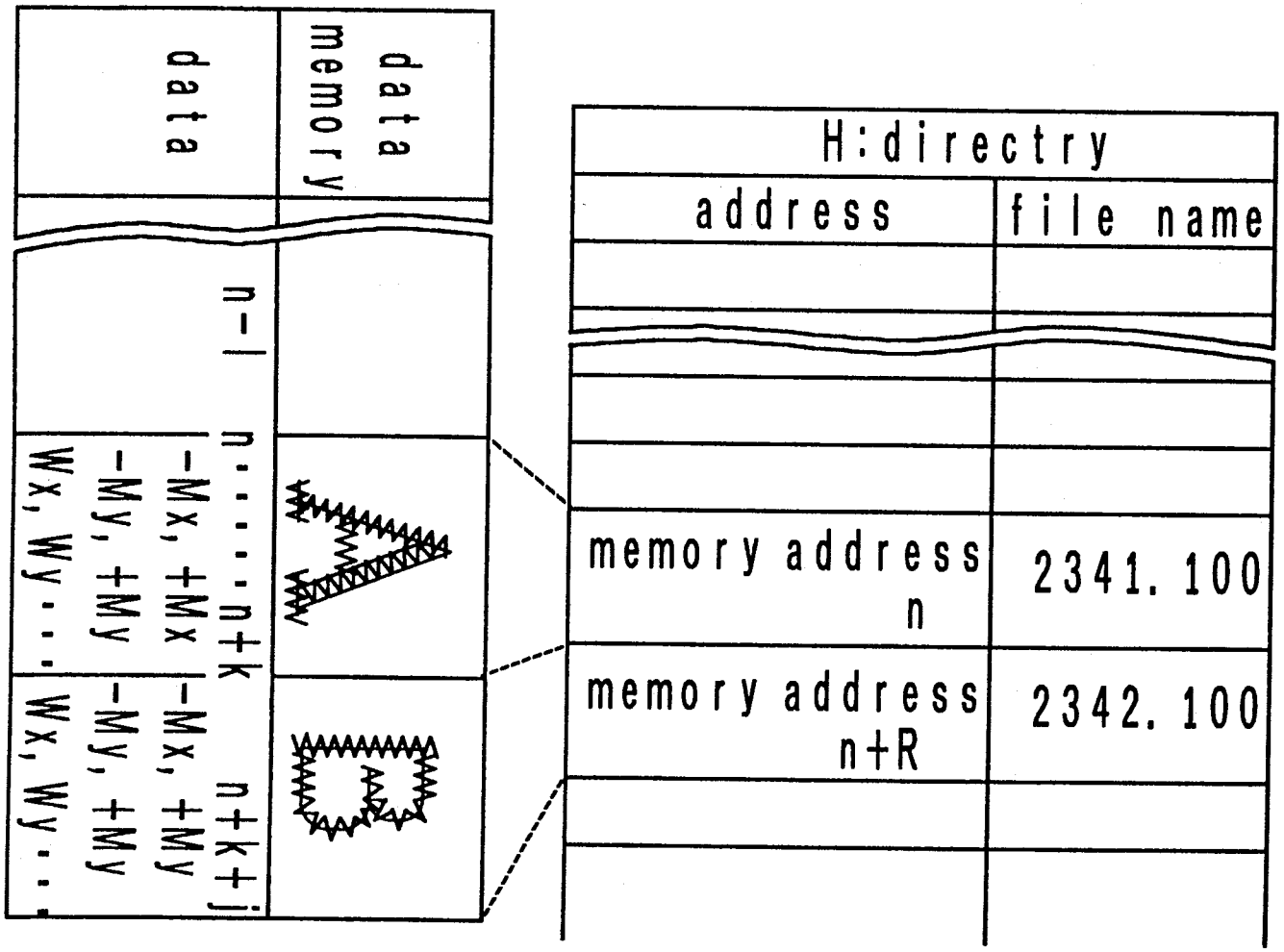
FIG. 25 is a chart which shows a relation between the codes of alphabetical characters displayed on the display 4 and stitch data.
Figure 30:
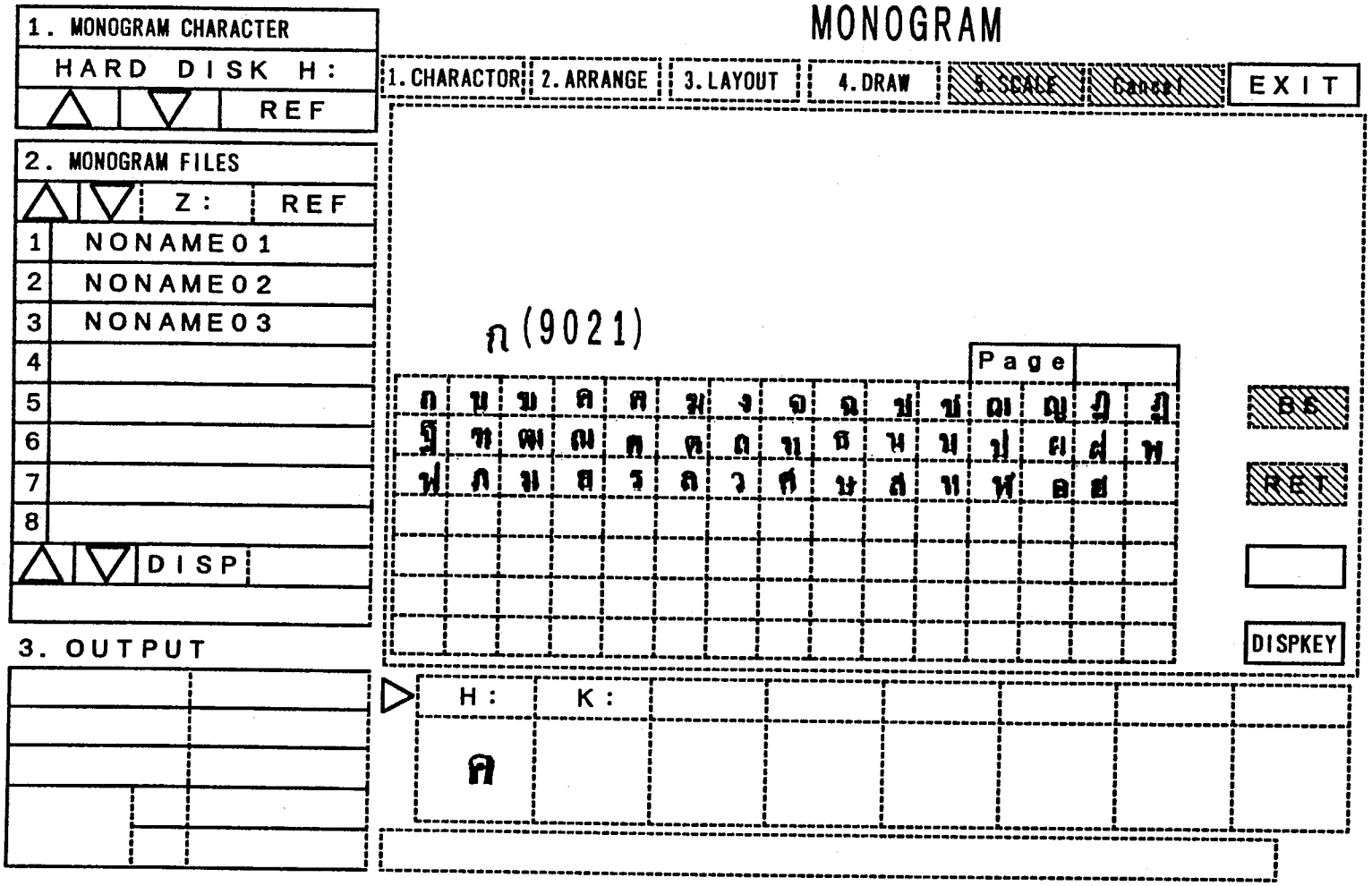
FIG. 30 is an image on the display 4 in accordance with the signals sent by the controller 1 shown in FIG. 2.

The keyboard screens shown in FIGS. 21, 30, 31 are standards characters. For example, Japanese language has different characters which pronouncement are the same. If an operator selects "A" key in the keyboard, the main computer 20 displays other characters which are pronounced the same as the "A" character as shown in FIG. 21. An operator selects the correct character from the display. The main computer 20 registers the code corresponding to the selected character in the name register shown in FIG. 24. In this process one character is selected. Each character has its own assigned code, for example, "A" is assigned to the code "2341" and "B" is assigned to the code "2342". An operator inputs desired characters into the name register. The embroidering data shown in FIG. 25 is stored in the hard disk 18 so that the main computer 20 can read the embroidering data corresponding to the selected character and write it with the character code into the name register.

Figure 13:
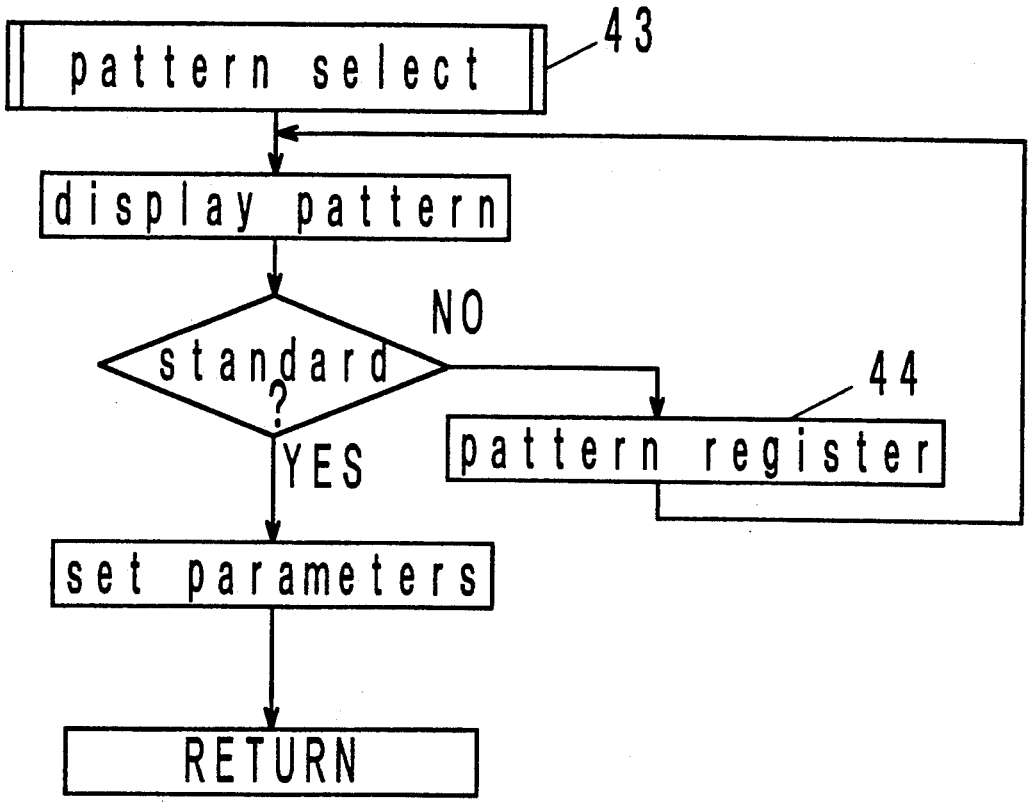
FIG. 13 is a flow chart which shows an operation of "selecting arrangement of patterns" 43 shown in FIG. 11.
Figures 32, 33:
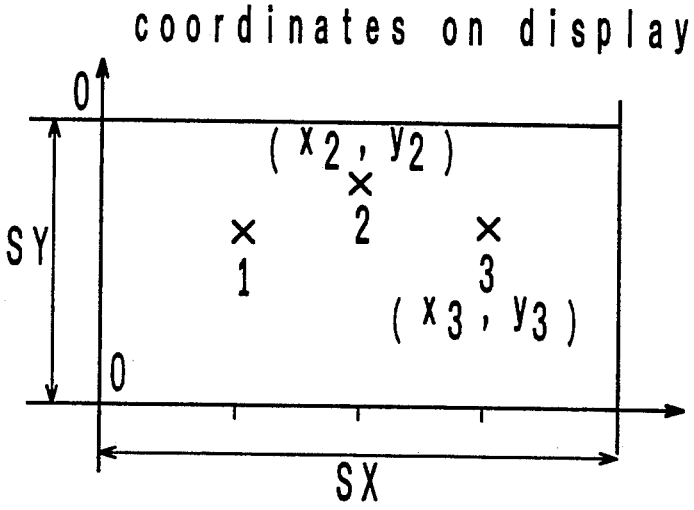
FIG. 32 is a drawing which shows the three points on the display 4.
FIG. 33 is a chart which shows data corresponds to the three points shown in FIG. 32 registered in the register.

After input of one character, an operator selects "2. ARRANGE" in FIG. 21 or 31. When "2. ARRANGE" in FIG. 21 is selected the main computer 20 executes the select pattern routine 43 in FIG. 1. FIG. 13 shows the operation of the select pattern 43. The main computer 20 displays the pattern registered in the hard disk 18. If there is no desired pattern in the registered patterns, an operator selects "Register Special Pattern" 44 shown in FIG. 13 to register the new pattern. An operator sets the embroidering parameters in "Parameter Set" in FIG. 13 such as "3. LAYOUT". When "3. LAYOUT" is selected, the main computer 20 executes "display arrangement mode" 46 in FIG. 11 to display the screen shown in FIG. 28. When an operator inputs the three points to arrange the letters along with a curve, the main computer 20 executes "input points" 47 in FIG. 11 to calculates a relative coordinates P(x,y) of the coordinates indicated in the scales SX, SY and saves it in the memory as shown in FIG. 33.

Figure 11:
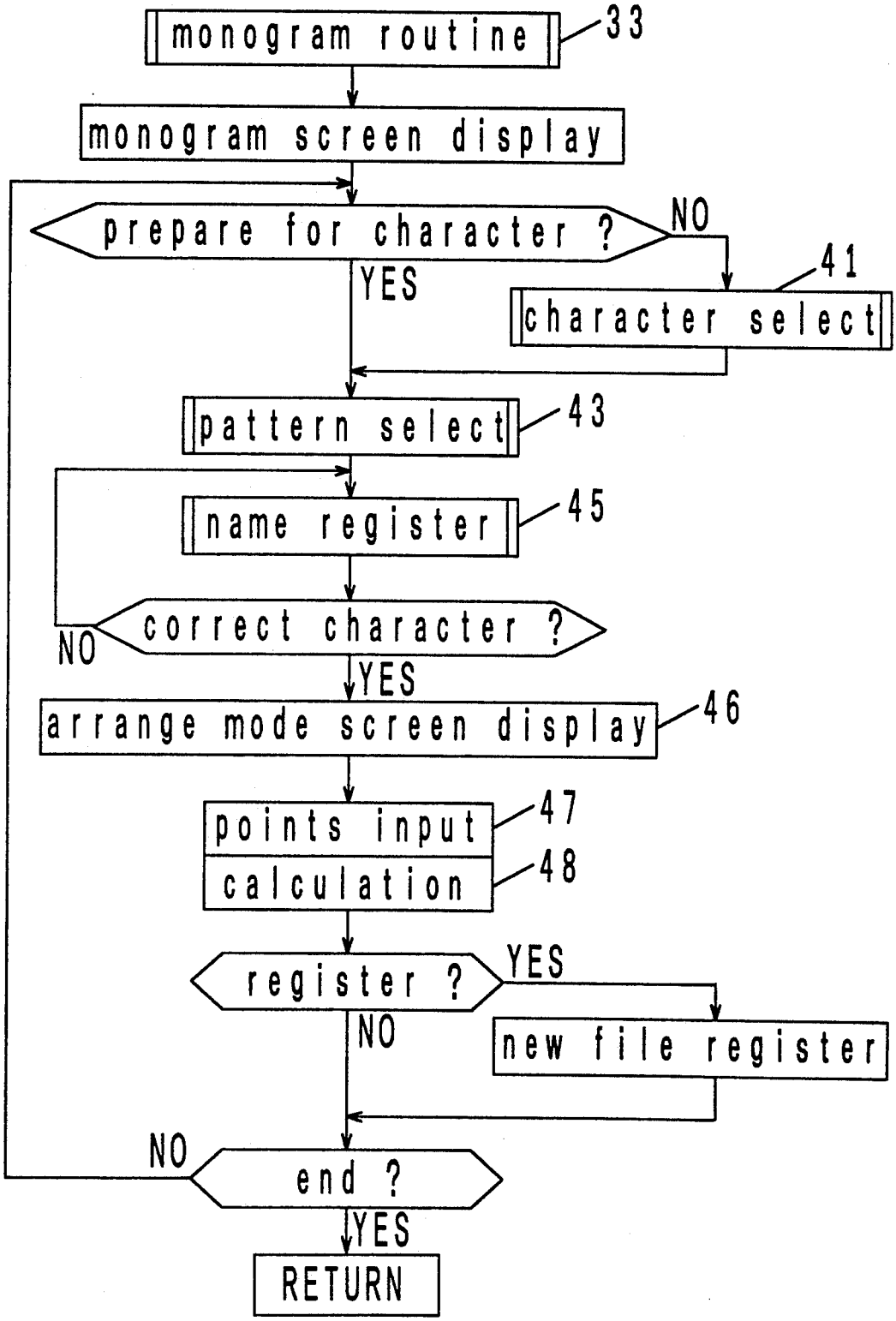
FIG. 11 is a flow chart which shows an operation of "monogram routine" 33 shown in FIG. 3.
Figure 12:
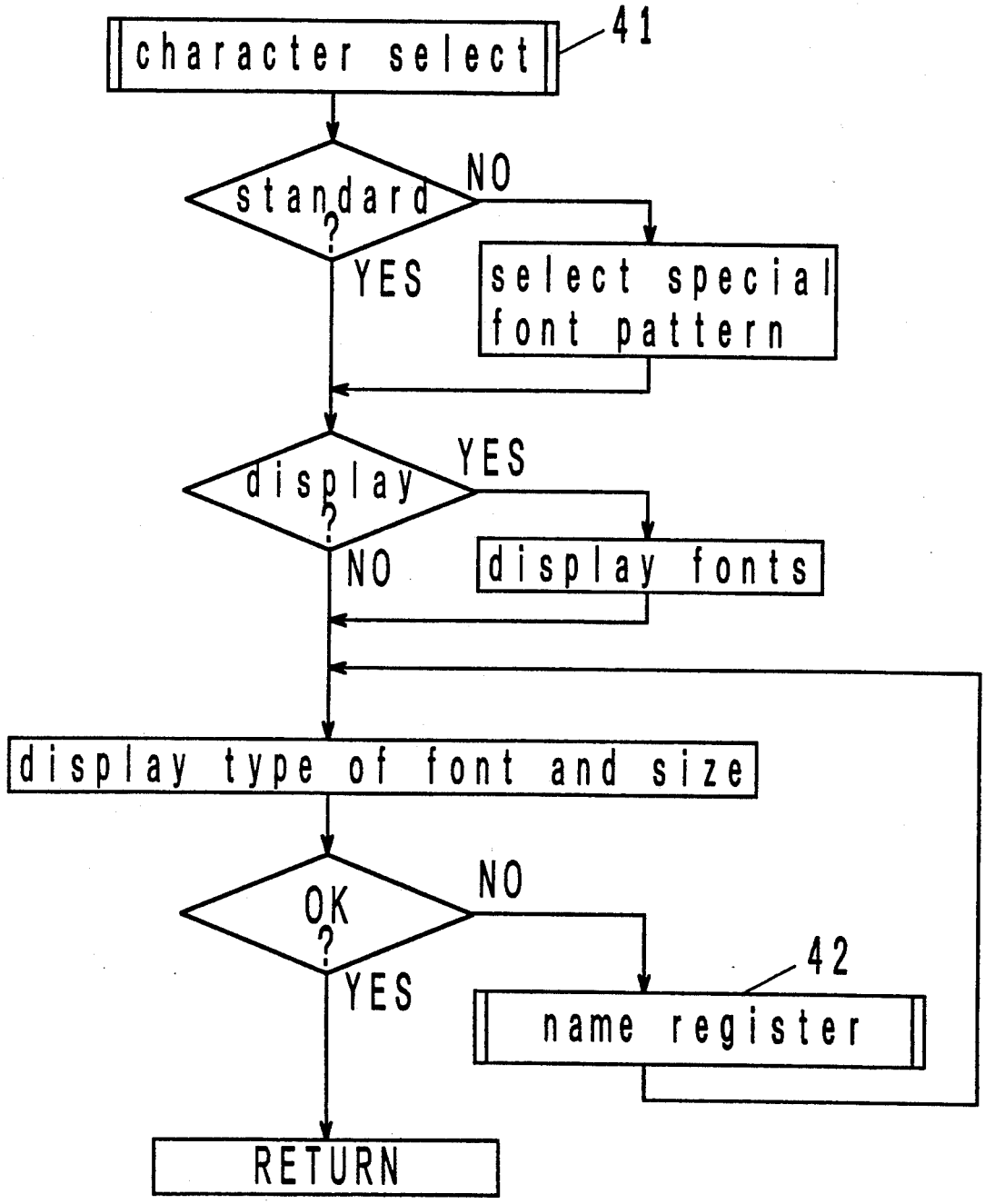
FIG. 12 is a flow chart which shows an operation of "selecting character types" 41 shown in FIG. 11.
Figure 28:
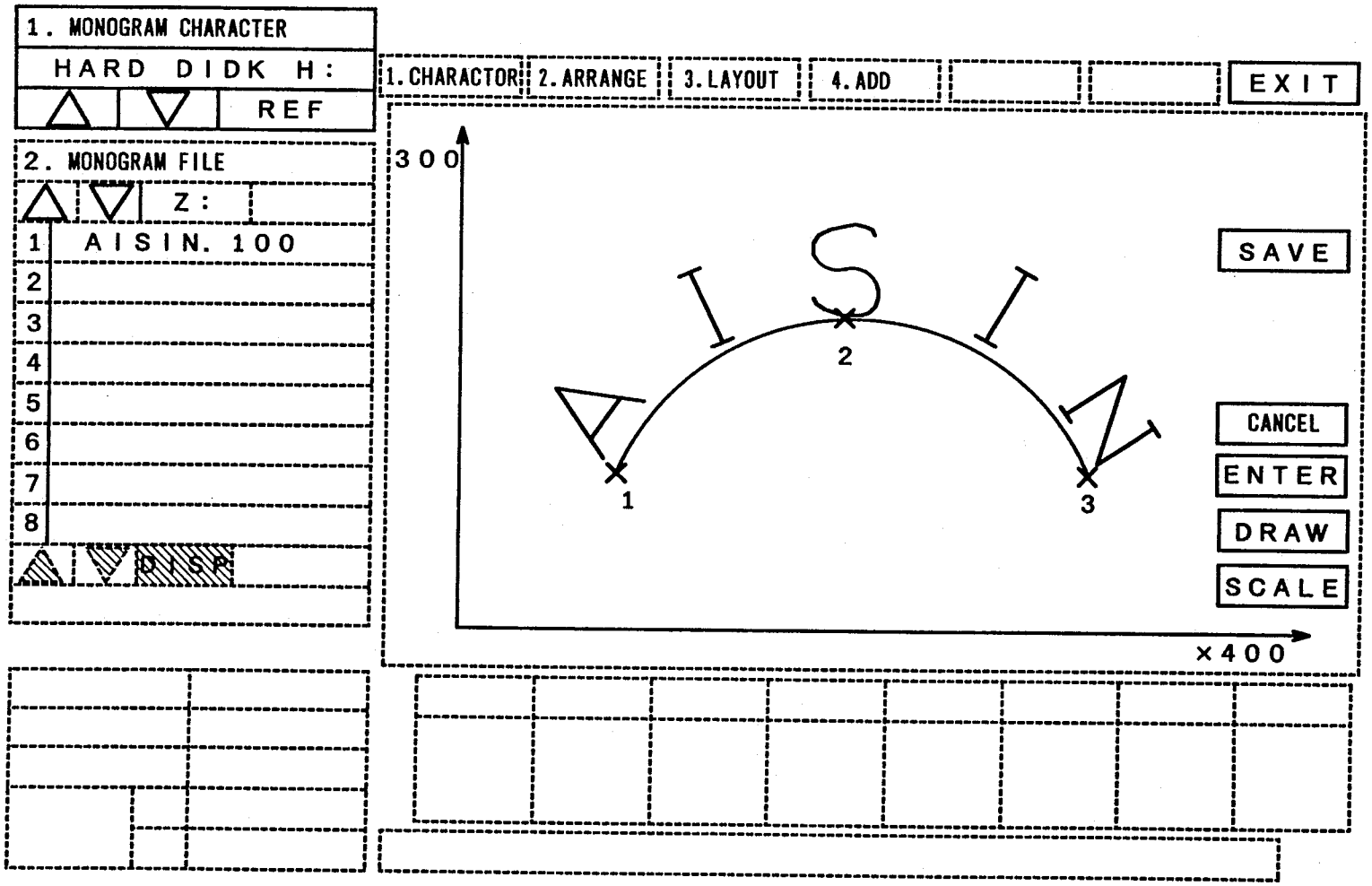
FIG. 28 is an image on the display 4 in accordance with the signals sent by the controller 1 shown in FIG. 2.
Figure 29A:
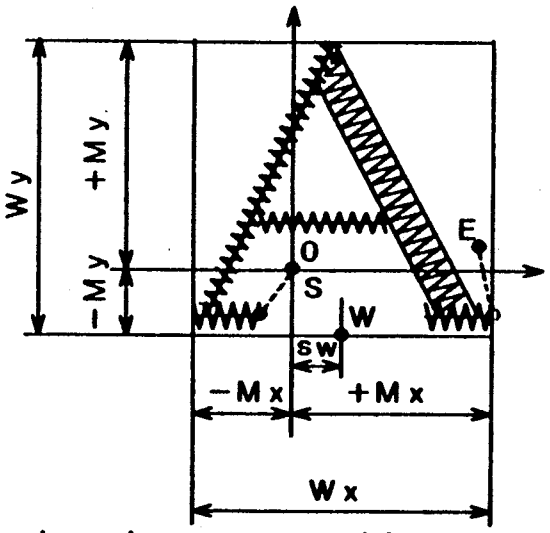
FIG. 29 is an image of characters on the display 4 which are combined in "combining routine" 36 shown in FIG. 3.
Figure 29B:
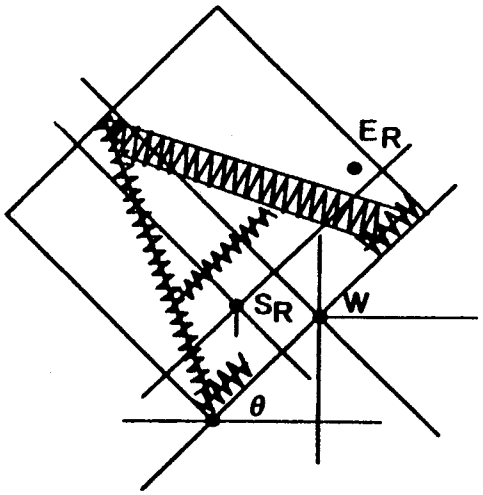

When an operator finishes to input all desired letters such as "AISIN" and inputs "DRAW" in the screen as shown in FIG. 28, the main computer 20 executes "calculate arrangement" 48 in FIG. 11 to display the arrangement "AISIN" as shown in FIG. 28.

Figure 26:
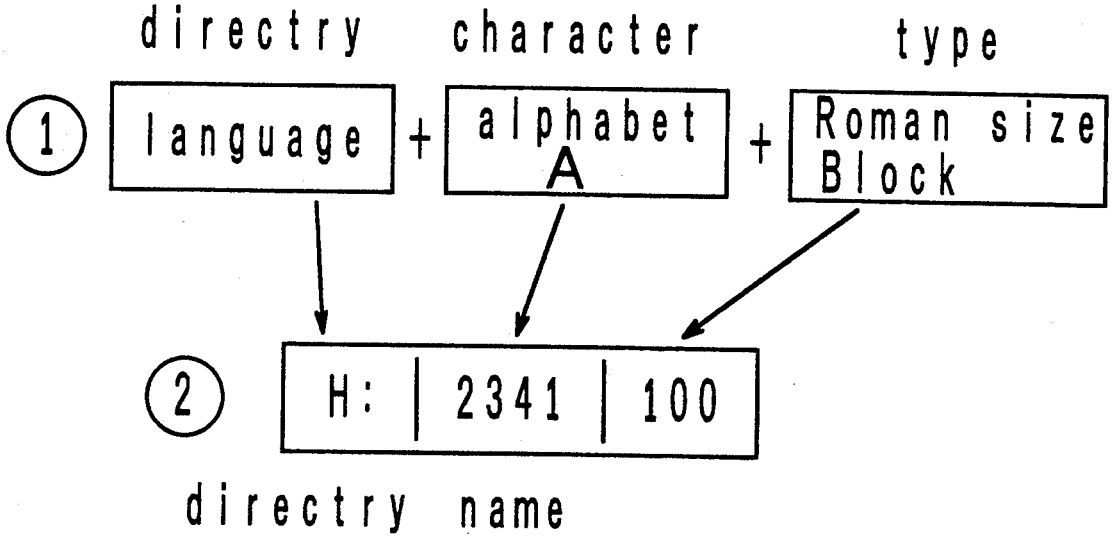
FIG. 26 is a chart which shows data a file name assigned to a combined pattern.
Figure 27:
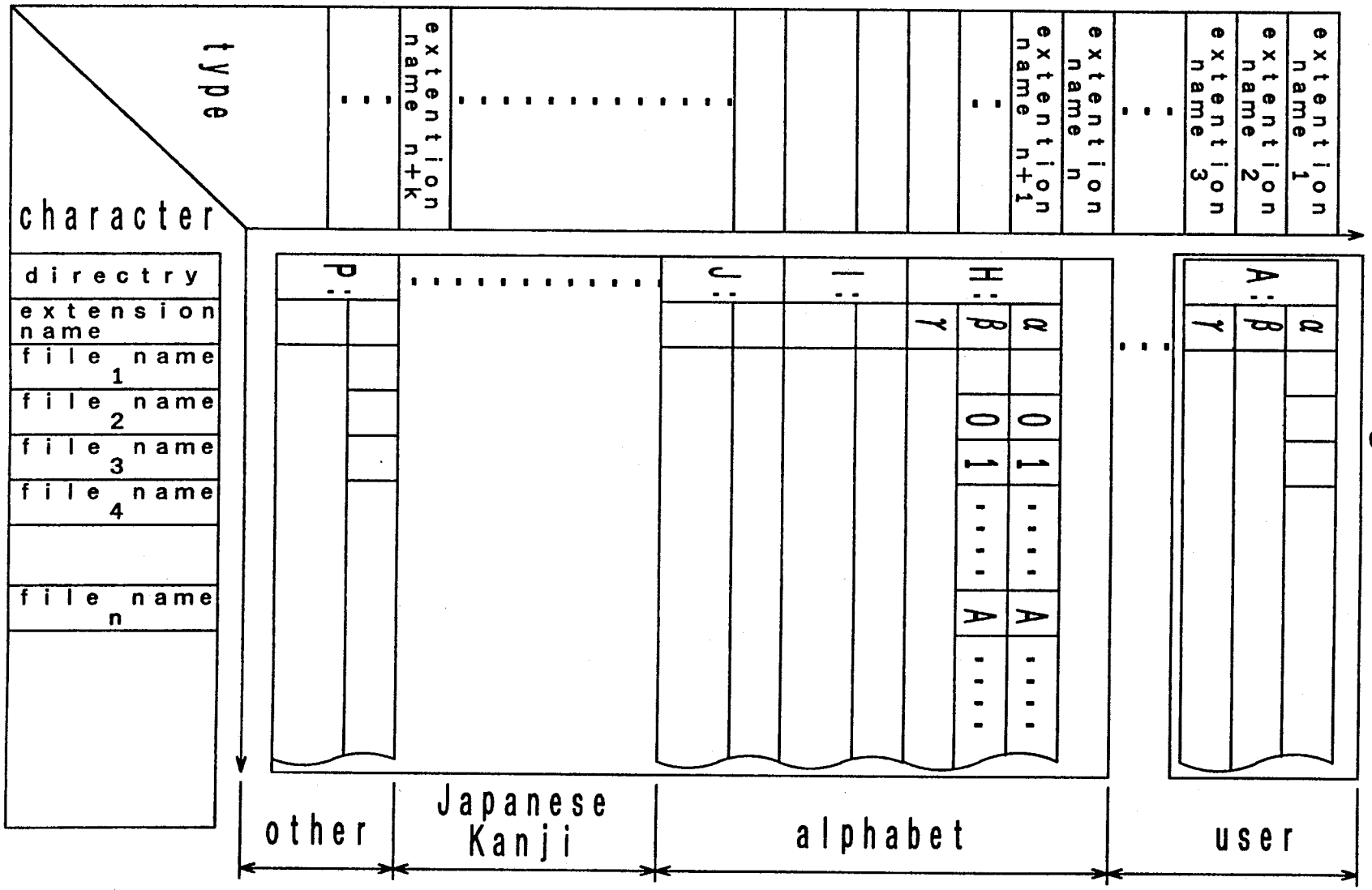
FIG. 27 is a memory map of the computer which corresponds to a keyboard displayed on the display 4.
Figures 34, 35:
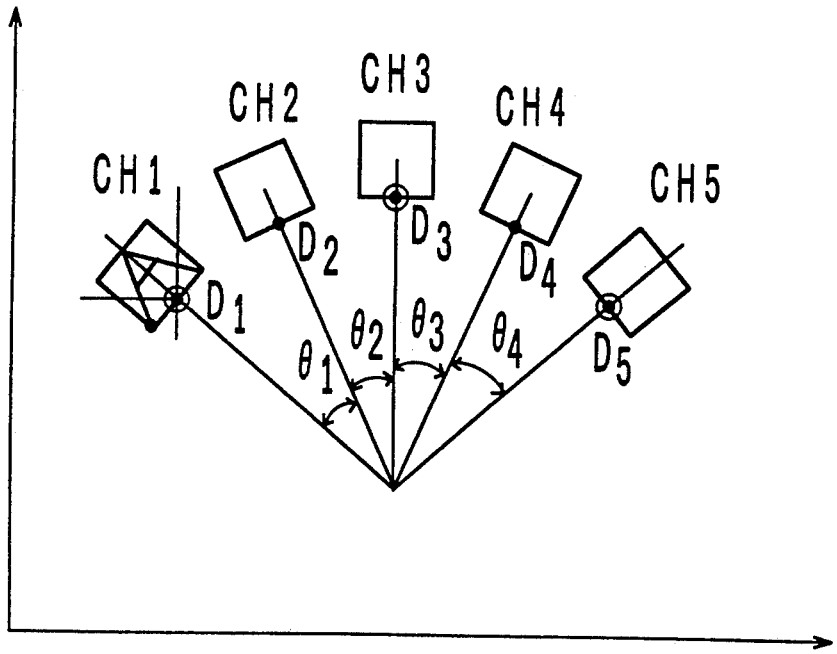
FIG. 34 is a chart which shows data of the layout register in accordance with the operation of "combined routine" 36 shown in FIG. 3.
FIG. 35 is an image on the display 4 in accordance with the signals of the "combining routine" 36.
Figure 36:
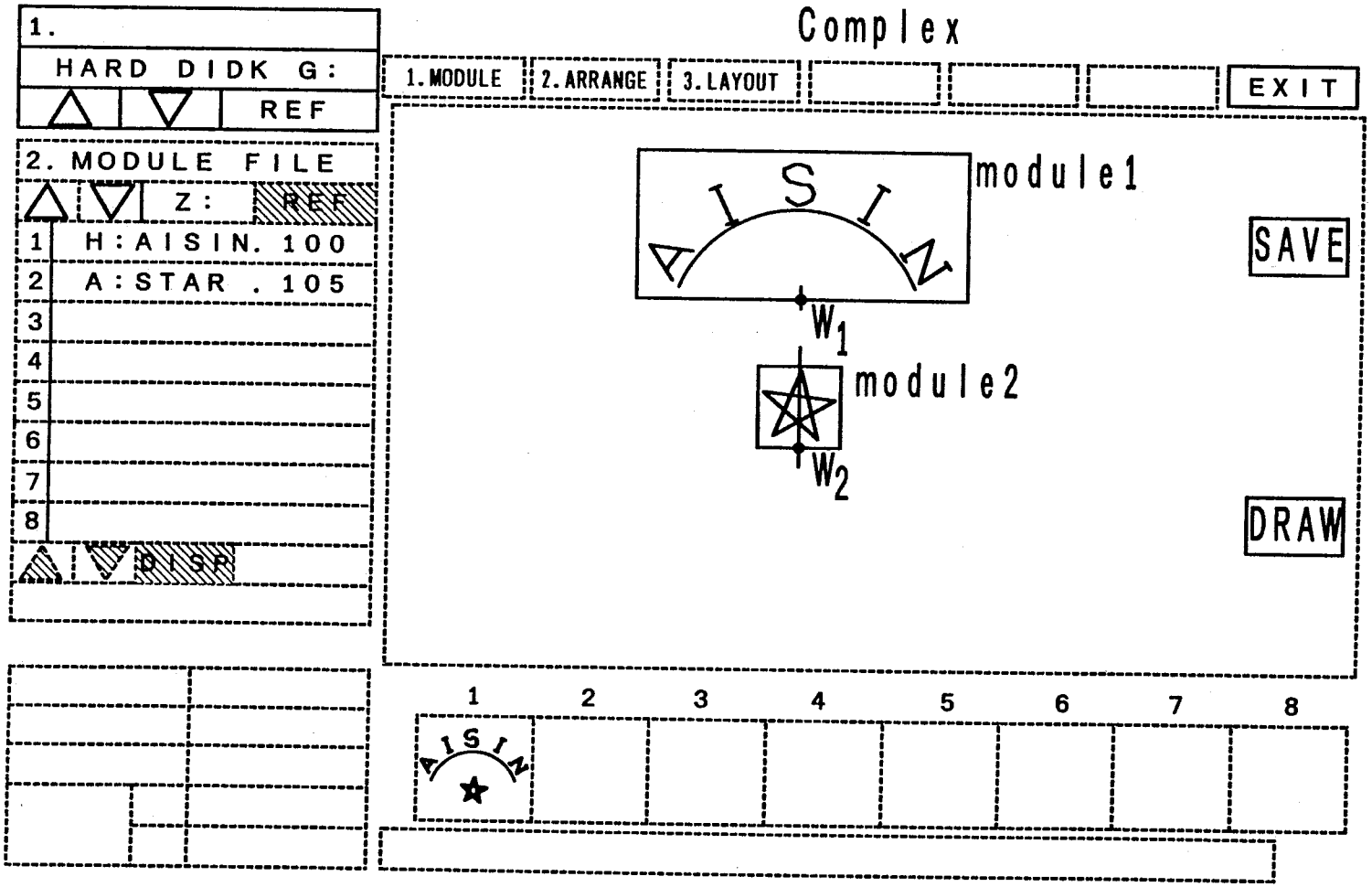
FIG. 36 is an image on the display 4 in accordance with the signals sent by the controller 1 shown in FIG. 2.
Figure 37:
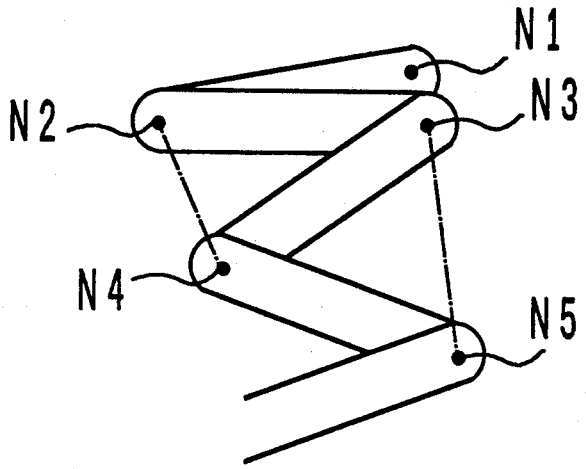
FIG. 37 is an enlarged image on the display 4 in accordance with the "thread density routine" 34 shown in FIG. 15.

When the three points are input, the main computer 20 divides the curve which goes through the three points into five points D1 to D5 as shown in FIG. 35 and writes the point coordinates into the layout register (FIG. 34). The starting point W of the embroidering data CH is placed on each divided coordinates R(x1, y1) to R(x5, y5). The main computer 20 rotates each character on the starting point W to where the character makes the right angle on the curve. The rotation angles are $\phi 1$ to $\phi 4$ shown in FIG. 35. The main computer 20 displays the rotated characters on the screen as shown in FIG. 28. After an operator confirms the display, an operator indicates to save the new data. The main computer 20 executes the "Register as new file" in FIG. 11 to save the data on the hard disk 18 with a new file name (FIG. 26). The main computer 20 then displays new file name at the "2. MONOGRAM" on the screen as shown in FIG. 28. The file name contains a directory of the keyboard pattern, letter code and character code. A directory assigned to the directory is shown in FIG. 27.

As the arrangement of alphabetical letters is mentioned above, arrangements of Japanese, Thai and Spanish letters are the same. An operator selects "1. CHARACTER" on the screen in FIG. 21 to change the screen to a "CHARACTER screen" then selects one of Japanese, Thai or Spanish. FIG. 30 shows Thai keyboards and FIG. 31 shows Japanese keyboards.

When an operator selects "6. COMPLEX" from the initial screen as shown in FIG. 16, the main computer 20 executes "combining routine" 36 in FIG. 14. First the combining screen is displayed. When an operator inputs "1. MODULE" at the top of the screen and selects a recording media either from the hard disk 18 or the floppy disk 14, the main computer 20 displays the file name in the recording media. The file names scrolls as an operator operates the cursor to select the desired one. Thus the basic pattern is selected. Then the additional pattern will be selected in the same way.

Figure 14:
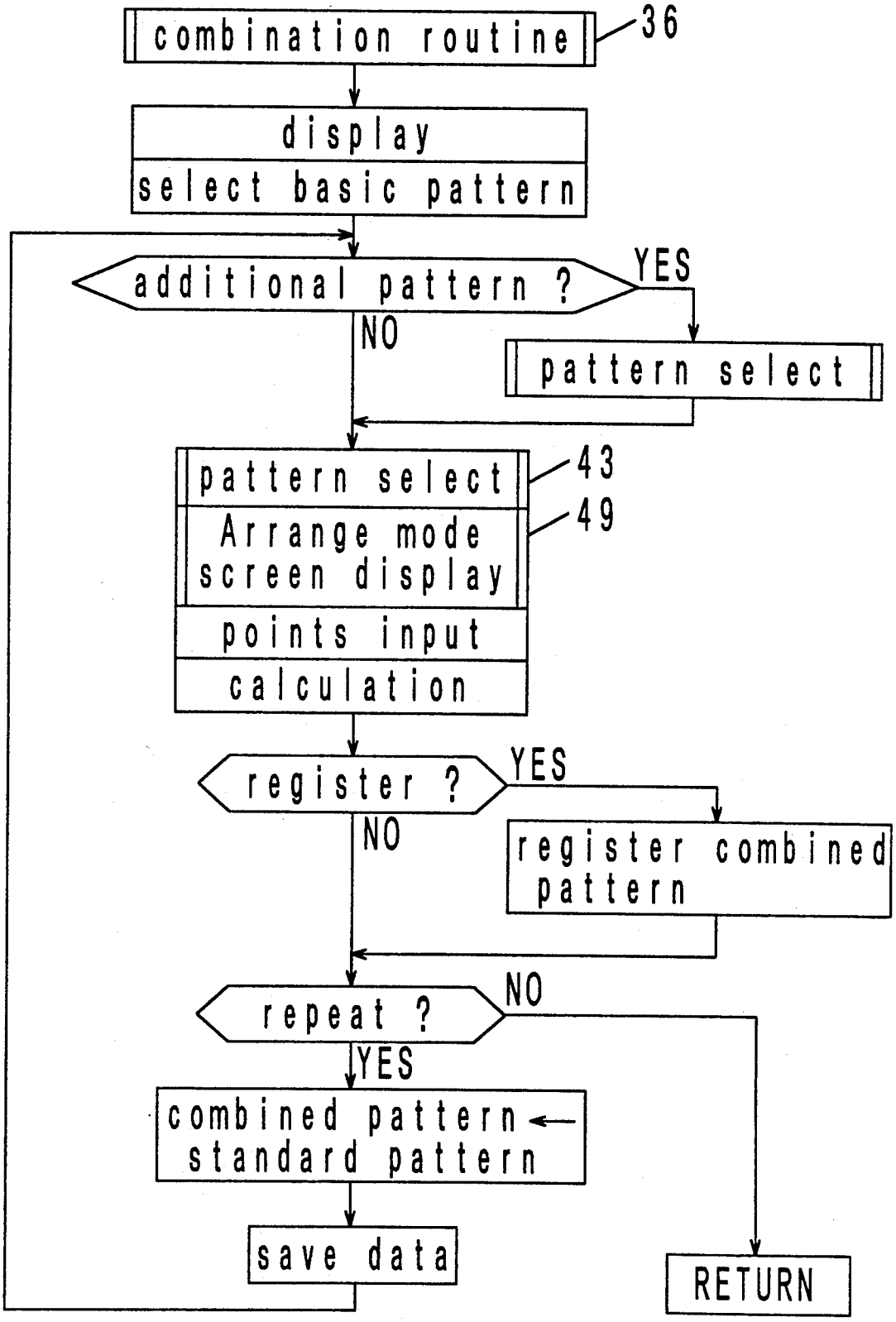
FIG. 14 is a flow chart which shows an operation of "combining routine" 36 shown in FIG. 3.
Figure 15:
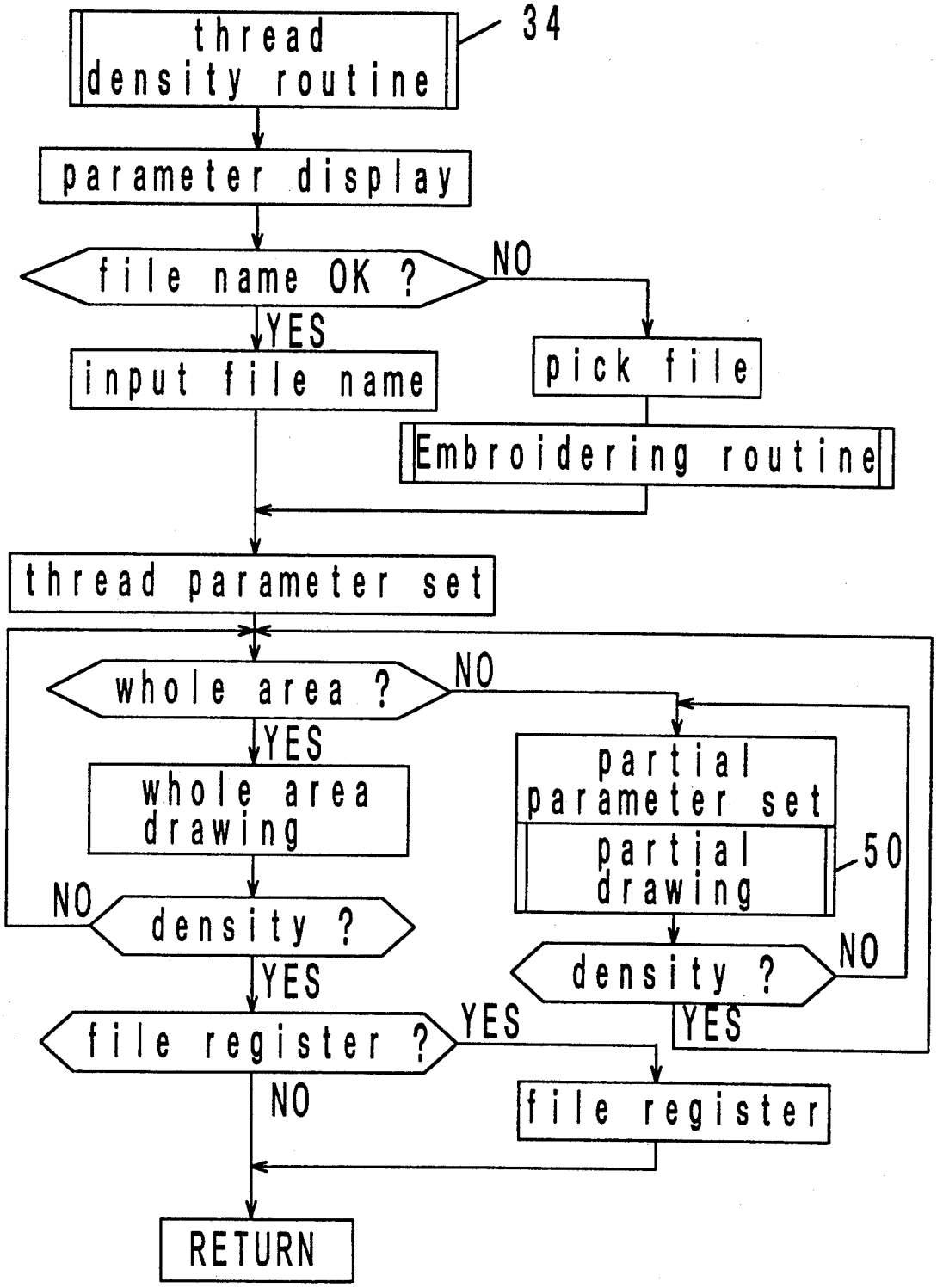
FIG. 15 is a flow chart which shows an operation of "thread density routine" 34 shown in FIG. 3.

An operator selects "2. Arrange" and the main computer 20 executes the "Select the patterns" 43 and "display arrange mode" through "Register the combined pattern". The operations are the same as that of the "Monograin" 33 in FIG. 11. A combined pattern can be made by continuing this process. The bottom four blocks of the FIG. 14 show one example of the combined pattern.

When an operator selects "4. THREAD DENSITY" from the initial screen (FIG. 16), the main computer 20 executes the "Thread density" routine 34. The main computer 20 displays "thread density parameter display" on the screen. An operator selects the file name from the screen and sets the parameters, such as enlarge or reduced rate of the thread and the area of the pattern to be checked. When the selected area does not cover the whole pattern, the process will be continued until the whole area is covered. The result will be displayed on the screen for an operator to check.

Figure 38:
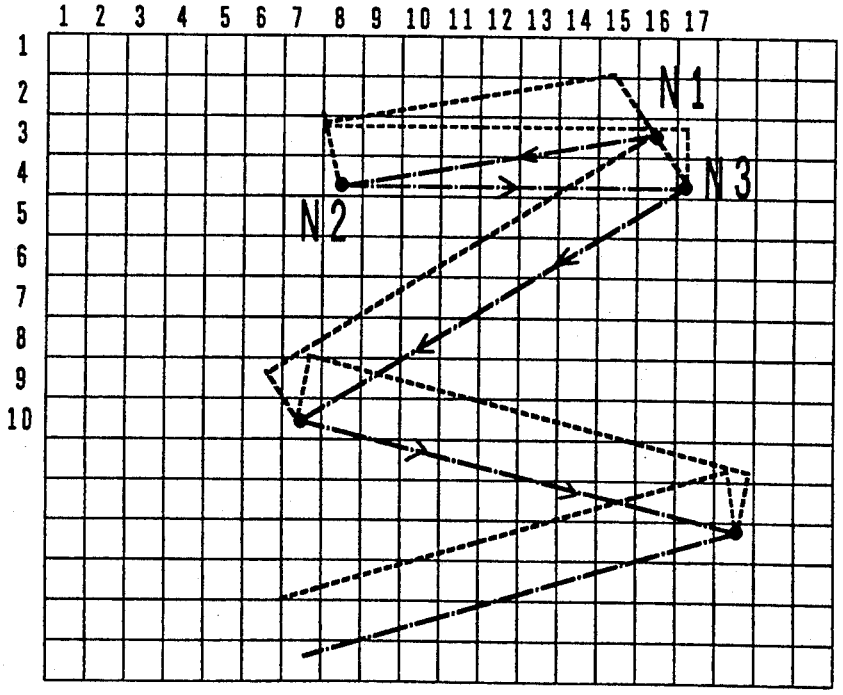
FIG. 38 is an enlarged image on the display 4 in accordance with the "thread density routine" 34 shown in FIG. 15.
Figure 39:
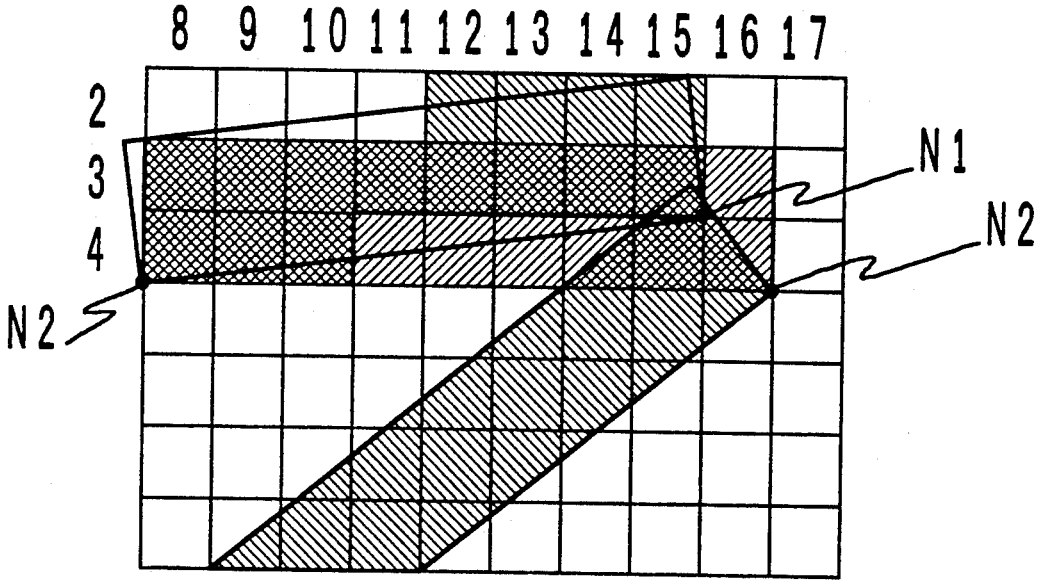
FIG. 39 is an enlarged image on the display 4 in accordance with the "thread density routine" 34 shown in FIG. 15.
Figure 40:
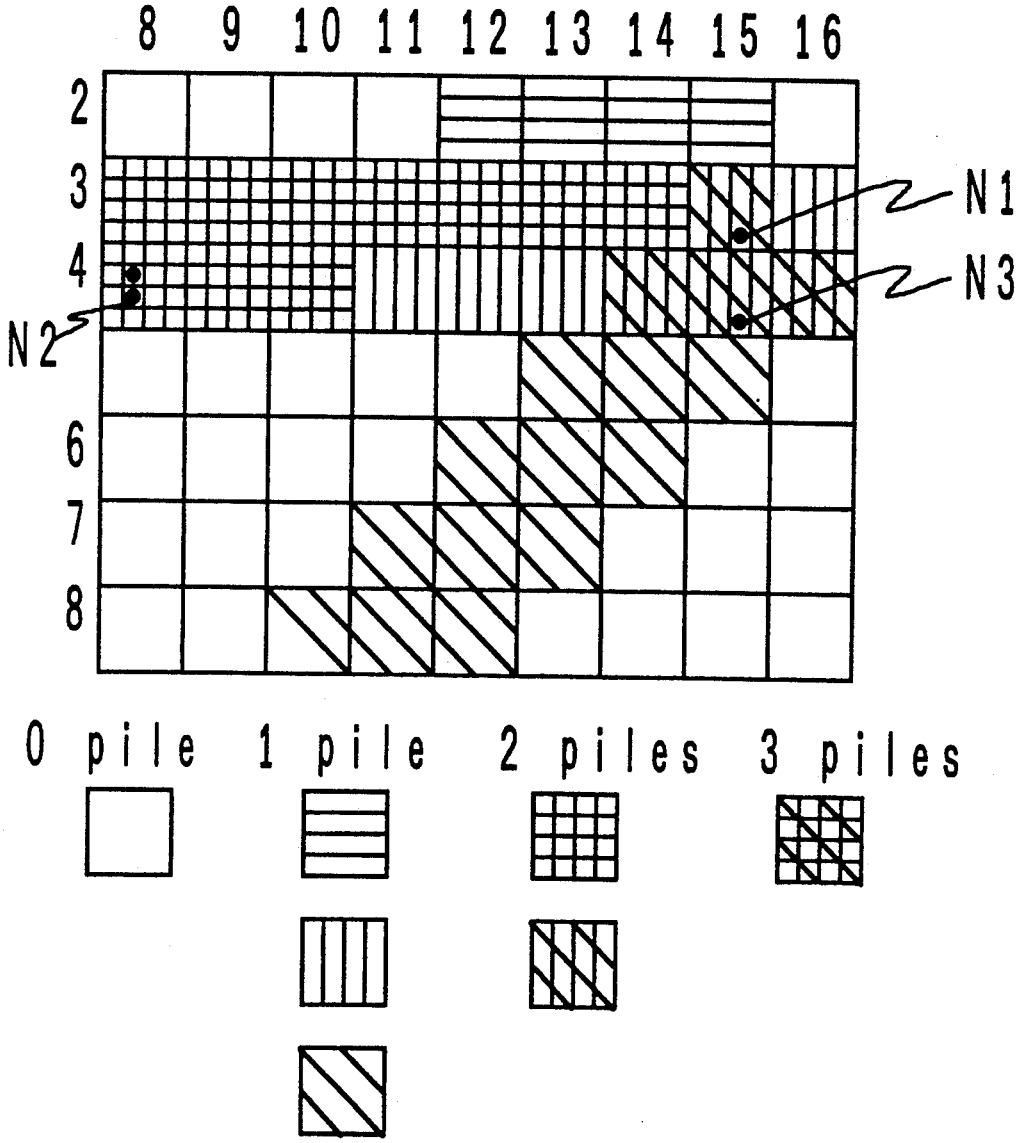
FIG. 40 is an enlarged image on the display 4 in accordance with the "thread density routine" 34 shown in FIG. 15.
Figure 41:
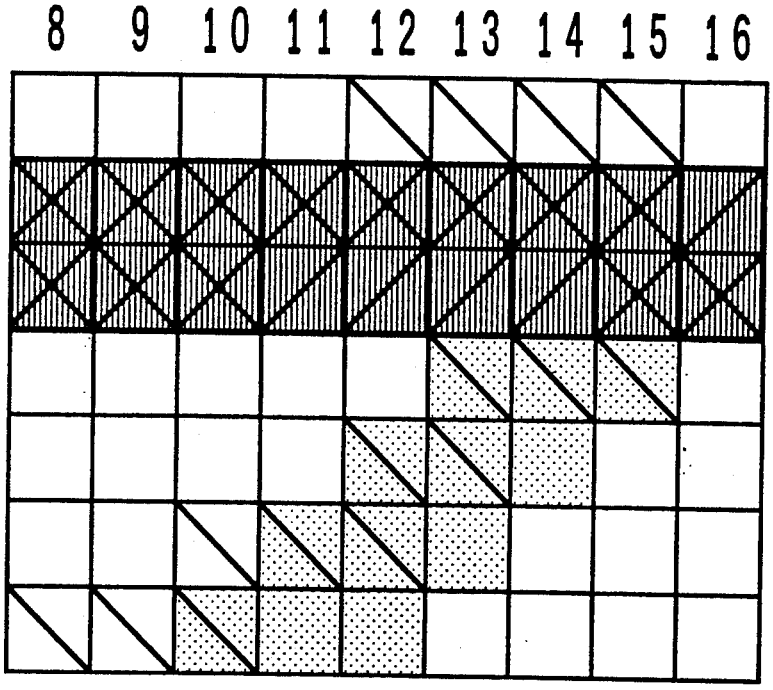
FIG. 41 is an enlarged image on the display 4 in accordance with the "thread density routine" 34 shown in FIG. 15.
Figure 42:
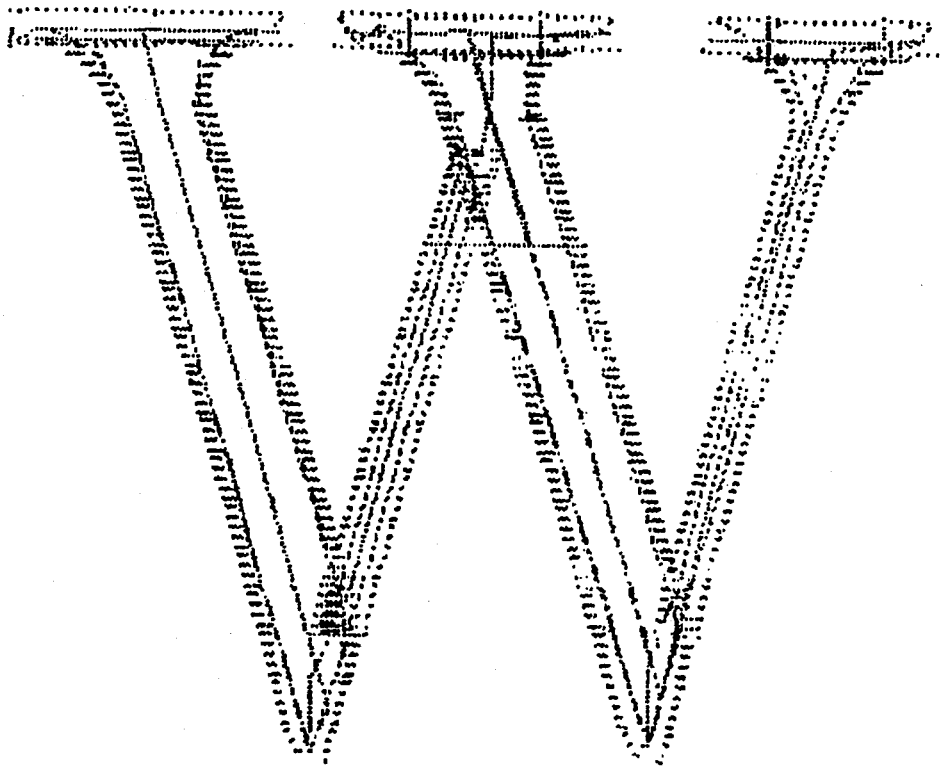
FIG. 42 is an image on the display 4 in accordance with the signals sent by the controller 1 shown in FIG. 2.

When the thread is embroidering along with the points N1- N2 - N3 - N4 - N5, some threads cross each other and some do not. If the thread density is too low, the cloth can be looked through the threads. In the "area drawing routine" 50 in FIG. 15, the main computer 20 draws lines along with the points N1 - N2 - N3 - N4 - N5 on the display 4. The pitch of the screen is 0.3 mm and the width of the thread is indicated as shown in FIG. 40. The line from the point N1 to the point N2 is drawn in color A. The line from the point N2 to the point N3 is drawn on with the color A but the crossing area on the line between N1 and N2 is colored in B (FIGS. 38, 39). The line from the point N3 to the point N4 is then drawn in color A but the crossing area is put in different color (FIGS. 40, 41). FIG. 42 shows a print out of the result with a dot matrix printer so the dot density shows thread density.

The invention has been described in an illustrative manner, and it is to be understood that the terminology which has been used in intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A system for embroidering comprising:

a plurality of embroidering machines, each embroidering machine further comprising:

an embroidery frame;

a frame motor for moving said frame in X and Y directions;

a needle motor for a needle;

memory means for storing embroidering data; and control means for controlling said frame motor and needle motor in accordance with said embroidering data;

display means;

input means having a keyboard and a means for inputting coordinates on a screen of said display;

register memory means for storing a plurality of embroidering patterns, image data and embroidering data;

main control means for;

(a) dividing a screen of said display means into multiple screens in accordance with a number input by said input means, each of the multiple screens corresponding to different embroidering machines in said embroidering system, (b) reading image data corresponding to said embroidering patterns selected by said input means from said register memory means, (c) displaying said image data on said multiple divided screens of said display means, and (d) sending embroidering data corresponding to said selected embroidering patterns to said memory means of said embroidering machine.

2. Apparatus according to claim 1, wherein said register memory means is a read and write data storage device.

3. Apparatus according to claim 2, wherein said data storage device has a removable data storage media.

4. Apparatus according to claim 1, wherein said main control means displays a piled area of the threads of said selected embroidering pattern on said display means so that the thread density can be checked.

5. A system for embroidering comprising:

a plurality of embroidering machines for embroidering any one of a number of different patterns on different clothes simultaneously, each of said plurality of embroidering machines further comprising:

an embroidery frame;

a frame motor for moving said frame in X and Y directions;

a needle motor for a needle;

memory means for storing embroidering data; and control means for controlling said frame motor and needle motor in accordance with said embroidering data;

display means;

input means having a keyboard and a means for inputting coordinates on a screen of said display means;

register memory means for storing a plurality of embroidering patterns, image data and embroidering data;

main control means for;

(a) dividing a screen of said display means into multiple screens in accordance with a number input by said input means, (b) reading image data corresponding to said embroidering patterns selected by said input means from said register memory means, (c) displaying said image data on said multiple divided screens of said display means, and (d) sending embroidering data corresponding to said selected embroidering patterns to said memory means of said embroidering machine.

6. A system for embroidering comprising:

a plurality of embroidering machines;

display means;

input means having a keyboard and a means for inputting coordinates on a screen of said display;

register memory means for storing a plurality of embroidering patterns, image data and embroidering data;

main control means for:

(a) dividing a screen of said display means into multiple screens in accordance with a number input by said input means, the number of multiple screens corresponding to the number of embroidering machines in said embroidering machine system; and (b) displaying said image data on said multiple divided screens of said display means.

* * * * *